US011471022B2

(12) United States Patent
Hong et al.

(10) Patent No.: US 11,471,022 B2
(45) Date of Patent: Oct. 18, 2022

(54) DISH WASHER

(71) Applicant: SAMSUNG ELECTRONICS CO., LTD., Suwon-si (KR)

(72) Inventors: Seung Gee Hong, Suwon-si (KR); Sung Jin Kim, Suwon-si (KR); Jin Doo Kim, Yongin-si (KR); Seul Gi Lee, Hwaseong-si (KR); In Ju Lee, Yongin-si (KR); Gyu Dong Jeon, Seoul (KR); Seung Min Chae, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 343 days.

(21) Appl. No.: 16/643,735

(22) PCT Filed: May 24, 2018

(86) PCT No.: PCT/KR2018/005892
§ 371 (c)(1),
(2) Date: Mar. 2, 2020

(87) PCT Pub. No.: WO2019/045231
PCT Pub. Date: Mar. 7, 2019

(65) Prior Publication Data

US 2020/0397211 A1 Dec. 24, 2020

(30) Foreign Application Priority Data

Aug. 31, 2017 (KR) ..... 10-2017-0111426
Aug. 31, 2017 (KR) ..... 10-2017-0111482

(51) Int. Cl.
*A47B 77/08* (2006.01)
*A47L 15/00* (2006.01)

(52) U.S. Cl.
CPC ..... *A47L 15/0086* (2013.01); *A47B 77/08* (2013.01)

(58) Field of Classification Search
CPC ..... A47B 77/08; A47L 15/0086
See application file for complete search history.

(56) References Cited

U.S. PATENT DOCUMENTS 3,648,878 A * 3/1972 Mackay ..... A47B 77/08 220/DIG. 25
2020/0221919 A1* 7/2020 Lee ..... A47L 15/4257
(Continued)

FOREIGN PATENT DOCUMENTS

CN 109680769 A * 4/2019 ..... A47L 15/0086
EP 2311347 A1 * 4/2011 ..... A47B 77/08
(Continued)

OTHER PUBLICATIONS

Extended European Search Report dated Jun. 2, 2020 in European Patent Application No. 18852270.0.
(Continued)

*Primary Examiner* — Matthew W Ing
(74) *Attorney, Agent, or Firm* — Staas & Halsey LLP

(57) ABSTRACT

Provided is a dish washer having an enhanced structure for usability. A dish washer may be installed in a built-in type in a system kitchen including a cabinet having a storage room and a counter arranged on the cabinet to have an opening. The dish washer includes a tub having a front opening, a front door provided to open or close the front opening, a cover frame mounted on the opening of the counter to be separated from the tub in a vertical direction of the dish washer, a top door installed on the cover frame to open or close the opening of the counter, and a coupling member coupling the cover frame to the tub to be expanded or contracted in the vertical direction of the dish washer.

17 Claims, 31 Drawing Sheets

(56) References Cited

U.S. PATENT DOCUMENTS

| | | | | |
|---|---|---|---|---|
| 2020/0221921 | A1* | 7/2020 | Ham | A47L 15/4259 |
| 2021/0153714 | A1* | 5/2021 | Choi | A47L 15/501 |

FOREIGN PATENT DOCUMENTS

| | | | |
|---|---|---|---|
| JP | 11-178661 | | 7/1999 |
| JP | 2001-61743 | | 3/2001 |
| JP | 2004-329249 | | 11/2004 |
| KR | 940009441 | B1 * | 10/1994 |
| KR | 10-0271711 | | 5/2001 |
| KR | 20-2011-0006400 | | 6/2011 |
| KR | 10-1643740 | | 7/2016 |
| SE | 443165 | B * | 2/1986 |

OTHER PUBLICATIONS

European Office Action dated May 17, 2022 in European Patent Application No. 18 852 270.0 (4 pages).

* cited by examiner

DISH WASHER

CROSS-REFERENCE TO RELATED APPLICATION

This application is a U.S. National Stage Application which claims the benefit under 35 U.S.C. § 371 of International Patent Application No. PCT/KR2018/005892 filed on May 24, 2018, which claims foreign priority benefit under 35 U.S.C. § 119 of Korean Patent Application No. 10-2017-0111426 filed on Aug. 31, 2017 and Korean Patent Application No. 10-2017-0111482 filed on Aug. 31, 2017 in the Korean Intellectual Property Office, the contents of all of which are incorporated herein by reference.

BACKGROUND

1. Field of the Disclosure

The disclosure relates to a dish washer, and more particularly, to a dish washer having an enhanced structure for usability.

2. Discussion of Related Art

Dish washers are machines for automatically cleaning and drying soiled dishes with a mix of water and detergent.

For example, a dish washer includes a main body having an open front and a tub installed therein, a door mounted on the main body to open or close the open front, a basket provided to contain dishes, and a spray nozzle provided to spray water. The front loading type dish washer may shed soiling around the dish washer while the dishes are loaded onto the basket.

In another example, a dish washer includes a main body having an open top and a tub installed therein, a door mounted on the main body to open or close the open top, a basket provided to contain dishes, and a spray nozzle provided to spray water. The top loading type dish washer may make it difficult to load dishes onto the basket because the vertical depth from the open top is deep.

Hence, expectations of a new type of dish washer that fixes the limitations with the front loading type dish washer and the top loading type dish washer increase.

SUMMARY OF THE DISCLOSURE

An embodiment of the disclosure provides a dish washer having an enhanced structure allowing dishes to be both front loaded and top loaded.

Another embodiment of the disclosure provides a dish washer having an enhanced structure to be built in system kitchens with various heights.

Another embodiment of the disclosure provides a dish washer having an enhanced structure allowing the user to easily open or close a top door.

In accordance with an aspect of the disclosure, a dish washer may be installed in a built-in type in a system kitchen that includes a cabinet having a storage room and a counter arranged on the cabinet to have an opening. The dish washer may include a tub having a front opening, a front door provided to open or close the front opening, a cover frame mounted on the opening of the counter to be separated from the tub in a vertical direction of the dish washer, a top door installed on the cover frame to open or close the opening of the counter, and a coupling member coupling the cover frame to the tub to be expanded or contracted in the vertical direction of the dish washer.

The coupling member may have the form of a closed loop.

The coupling member may include an elastic material.

The coupling member may include at least one bent portion.

The coupling member may have a first end coupled to the cover frame, and a second end coupled to the tub and located outside the first end.

The first end of the coupling member may be located outside the cover frame to cover an outer surface of the cover frame. The dish washer may further include a wire arranged along edges of the coupling member to fix the first end of the coupling member to the cover frame.

The tub may include a top opening corresponding to the opening of the counter, and the second end of the coupling member may be coupled to an inner surface of the tub after passing through the top opening of the tub.

The dish washer may further include a fastening member fixing the second end of the coupling member to the inner surface of the tub from inside of the tub to an upward direction of the dish washer.

The dish washer may further include a fastening member fixing the second end of the coupling member to the inner surface of the tub in a left-right direction or front-back direction of the dish washer.

The cover frame may have an outer surface with a plurality of projections arranged to be separated from each other in the vertical direction of the dish washer, and the first end of the coupling member may include a latch caught in between the plurality of projections.

The cover frame may have one end toward the tub with a coupling groove formed along edges of the cover frame, and the first end of the coupling member may have a coupler to be coupled into the coupling groove.

The tub may include a tub body and a tub top coupled into an upper portion of the tub body and having a water collector, and the coupling member may couple the cover frame to the tub top.

In accordance with another aspect of the disclosure, a dish washer may be installed in a built-in type in a system kitchen that includes a cabinet having a storage room and a counter arranged on the cabinet to have an opening. The dish washer may include a tub having a front opening, a front door provided to open or close the front opening, a cover frame mounted on the opening of the counter, a top door installed on the cover frame to open or close the opening of the counter, and a coupling member provided to define a space located between the cover frame and the tub in a vertical direction of the dish washer.

The space defined by the coupling member may vary by thickness of the counter.

The space defined by the coupling member may increase when the counter is thick and decrease when the counter is thin.

The coupling member is able to expand or contract in the vertical direction of the dish washer.

The cover frame may be mounted on the opening of the counter to be separated from the tub in the vertical direction of the dish washer.

The cover frame may include a first space in which the top door is rested, and a second space located under the first space in the vertical direction of the dish washer, and the space defined by the coupling member may be located between the second space and the tub in the vertical direction of the dish washer.

The first space may be larger in width than the second space.

The coupling member may include at least one bent portion.

The coupling member may have a first end coupled to the cover frame, and a second end coupled to the tub and located outside the first end.

In accordance with another aspect of the disclosure, a dish washer may be installed in a built-in type in a kitchen system including a cabinet having a storage room and a counter arranged on the cabinet to have an opening. The dish washer may include a tub having a front opening, a front door installed on the tub to open or close the front opening, a cover frame mounted on the opening of the counter, and a top door installed on the cover frame to open or close the opening of the counter.

In accordance with another aspect of the disclosure, a dish washer may be installed in a built-in type in a kitchen system including a cabinet having a storage room and a door provided to open or close the storage room and a counter arranged on the cabinet to have an opening. The dish washer may include a tub having a front opening, a front door installed on the tub to open or close the front opening, a cover frame mounted on the opening of the counter, and a top door installed on the cover frame to open or close the opening of the counter, wherein the front door defines a front exterior of the kitchen system together with the door of the cabinet.

In accordance with another aspect of the disclosure, a dish washer may be installed in a built-in type in a system kitchen that includes a cabinet having a storage room and a counter arranged on the cabinet to have an opening. The dish washer may include a tub having a front opening, a front door provided to open or close the front opening, a top door provided to open or close the opening of the counter, and a handle including an extension portion coupled to the top door and a grip portion arranged at one end of the extension portion and located further forward than the front end of the top door.

The extension portion may include a first extension extending upward from the top surface of the top door and a second extension extending forward from the first extension to the grip portion.

The grip portion may be arranged above the counter.

The extension portion may extend from the top surface of the top door to the grip portion at an angle with the top surface of the top door.

The grip portion may be arranged further forward than the front end of the counter.

The extension portion may include a first extension extending forward from the top surface of the top door and a second extension extending upward from the first extension to the grip portion.

The extension portion may extend forward from the top surface of the top door to the grip portion, and the grip portion may be formed to include a more flexible material than for the extension portion.

The extension portion may include a first extension portion coupled to an end of the grip portion and a second extension portion coupled to the other end of the grip portion, and the top door may include a first coupling projection with which the first extension portion is slidingly coupled and a second coupling projection with which the second extension portion is slidingly coupled.

The handle may include a fixing member to fix the second extension portion to the second coupling projection.

The first coupling projection may include a coupling groove sunken to a perpendicular direction to a direction in which the top door is opened or closed, and the first extension portion may include a projection to be inserted to the coupling groove.

The first extension portion may include a first insertion groove formed with a sunken portion of the outer surface of the first extension portion to be slidingly coupled with the first coupling projection, and the second extension portion may include a second insertion groove formed with a sunken portion of the outer surface of the second extension portion to be slidingly coupled with the second coupling projection.

The first coupling projection defines a portion of the outer surface of the first extension portion while inserted to the first insertion groove, and the second coupling projection defines a portion of the outer surface of the second extension portion while inserted to the second insertion groove.

The extension portion may slide in a perpendicular direction to a direction in which the top door is opened or closed, to be coupled with the top door.

In accordance with another aspect of the disclosure, a dish washer may include a tub having a front opening and a top opening, a front door provided to open or close the front opening, a top door provided to open or close the top opening, and a handle arranged at the other end opposite to one end at which a rotation axis of the top door is located, extending from the top door to above the counter, separated from the top surface of the counter by a certain distance above to form a grip space with the counter.

The handle may include first and second extension portions coupled to the top door, and the top door may include a first coupling projection with which the first extension portion is slidingly coupled and a second coupling projection with which the second extension portion is slidingly coupled.

The second extension portion may be fixed to the second coupling projection by a fixing member.

The first coupling projection defines a portion of the outer surface of the first extension portion while coupled with the first extension portion, and the second coupling projection defines a portion of the outer surface of the second extension portion while coupled with the first extension portion.

The first coupling projection may include a coupling groove sunken to a perpendicular direction to a direction in which the top door is opened or closed, and the first extension portion may include a projection to be inserted to the coupling groove.

The first extension portion may include a first insertion groove formed with a sunken portion of the outer surface of the first extension portion to be slidingly coupled with the first coupling projection, and the second coupling projection may include a coupling groove formed along a direction of slidingly coupling to the second extension portion, and a projection may be formed in the insertion groove to be inserted to the coupling groove in a direction of slidingly coupling to the second coupling projection.

In accordance with another aspect of the disclosure, a dish washer may be installed in a built-in type in a system kitchen that includes a cabinet having a storage room and a counter arranged on the cabinet to have an opening. The dish washer may include a top door provided to open or close the opening of the counter and having first and second coupling projections formed on the top surface of the top door, and a handle fixed to the top door, and the handle may include a grip portion located further forward than the front end of the top door and defining a grip space by being separated from the counter by a certain distance, a first extension portion coupling the grip portion to the top door and slidingly coupled with the first coupling projection, and a second extension portion coupling the grip portion to the top door and slidingly coupled with the second coupling projection.

BRIEF DESCRIPTION OF THE DRAWINGS

The above and other objects, features and advantages of the disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
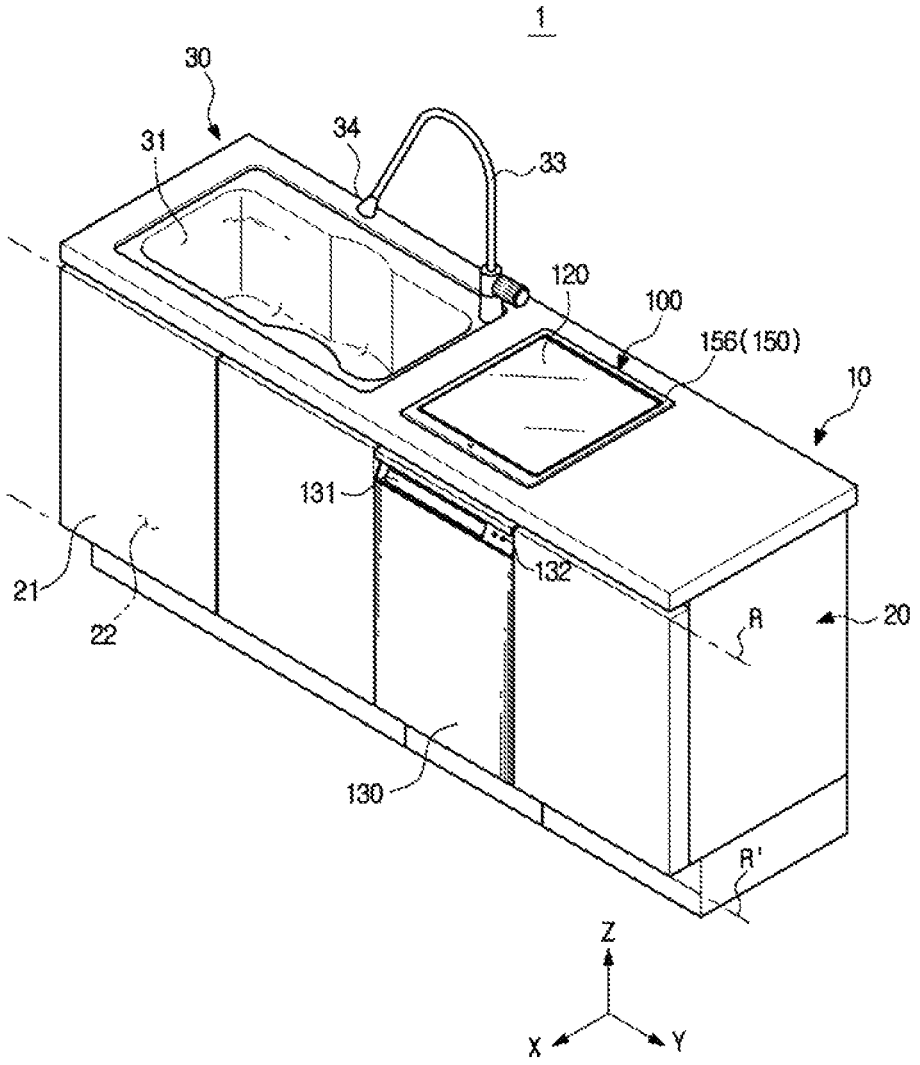
FIG. 1 shows a system kitchen with a built-in dish washer installed therein, according to an embodiment of the disclosure.

Reference will now be made in detail to embodiments of the disclosure, examples of which are illustrated in the accompanying drawings, wherein like reference numerals refer to the like elements throughout. The terms "front", "rear", "upper", "lower", "top", and "bottom" as herein used are defined with respect to the drawings, but the terms may not restrict the shape and position of the respective components.

Figure 2:
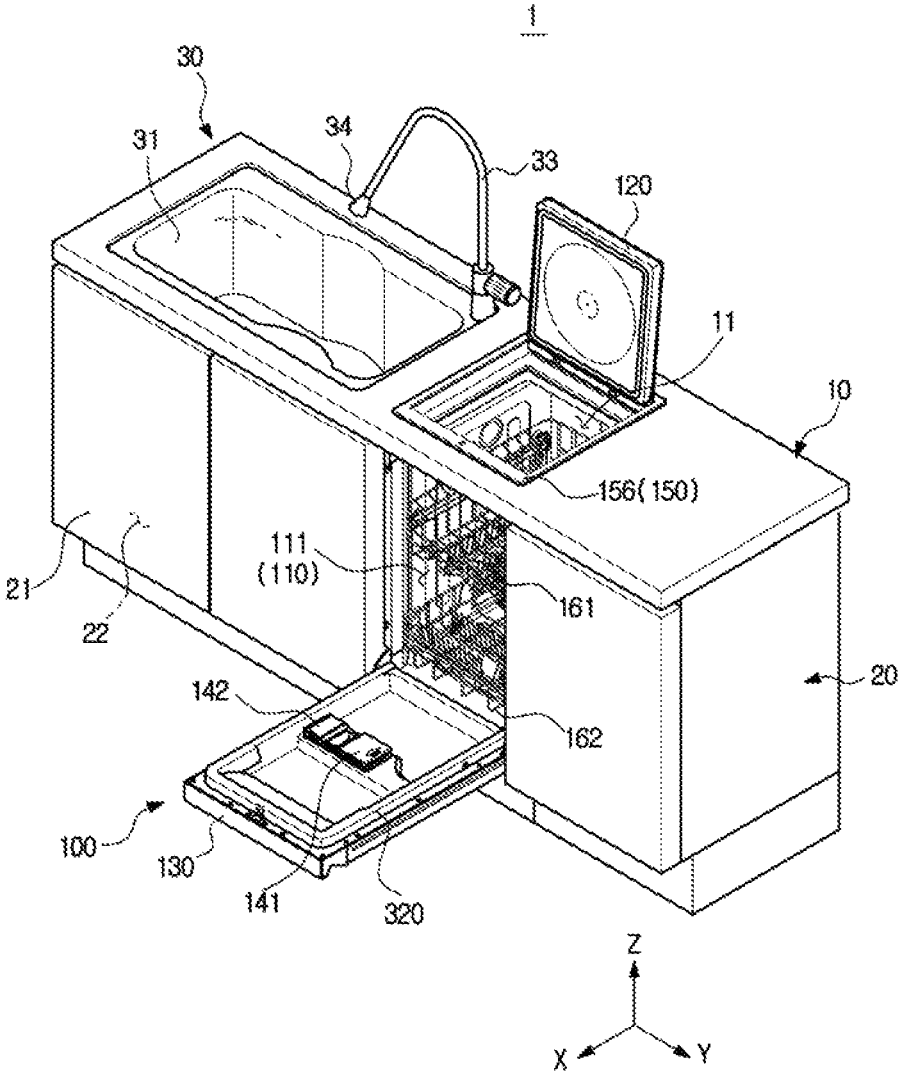
FIG. 2 shows the built-in dish washer of the system kitchen of FIG. 1 with both front and top doors of the dish washer open.

FIG. 1 shows a system kitchen with a built-in dish washer installed therein, according to an embodiment of the disclosure, and FIG. 2 shows the built-in dish washer of the system kitchen of FIG. 1 with both front and top doors of the dish washer open. In the following description, 'X' indicates a front-back (or back-front) direction of a system kitchen 1, 'Y' indicates a left-right (or right-left) direction of the system kitchen 1, and 'Z' indicates a vertical direction of the system kitchen 1. The left-right direction of the system kitchen 1 may also be referred to as a width direction of the system kitchen 1. The vertical direction of the system kitchen 1 may also be referred to as a height direction of the system kitchen 1. Furthermore, the front-back direction, the left-right direction, and the vertical direction of the system kitchen 1 may also correspond to those directions of a dish washer 100.

Referring to FIGS. 1 and 2, the system kitchen 1 may include a cabinet 20 having a storage room 22, and a counter 10 placed on the cabinet 20. The counter 10 may have the form of a flat plate. The counter 10 may also be termed a 'counter top'. The counter 10 may have an opening 11 formed therethrough.

In the cabinet 20, there may be the storeroom 22 in which various kitchen items are stored. The storeroom 22 may be opened or closed by a cabinet door 21. For example, the cabinet door 21 may be pivotally mounted.

The cabinet 20 may include a partition wall (not shown) placed inside the cabinet 20 to divide the storage room 22. For example, the partition wall may extend in the vertical direction Z of the system kitchen 1 to divide the storage room 22 into multiple spaces.

The system kitchen 1 may further include a sink 30 provided for washing dishes or cleaning groceries. The sink 30 may be provided on a side of the counter 10. The sink 30 may include a sink bowl 31 installed at the counter 10 to clean dishes or groceries. A drain (not shown) may be provided at the sink bowl 31 for water supplied into the sink bowl 31 to be discharged. The sink 30 may further include a water pipe 33 installed adjacent to the sink bowl 21 to supply water into the sink bowl 31. A tap 34 may be coupled to an end of the water pipe 33. The water supplied into the sink bowl 31 from the tap 34 may be discharged through the drain and a drainpipe (not shown).

The system kitchen 1 may further include a built-in dish washer 100 installed in the system kitchen 1.

The dish washer 100 may include a plurality of doors 120 and 130 for user convenience. Specifically, the dish washer 100 may include a top door 120 provided for top loading of dishes, and a front door 130 provided for front loading of dishes. The top door 120 and the front door 130 may each be pivotally installed. The forms of installation of the top door 120 and front door 130 are not, however, limited thereto, but may be variously changed. For example, the top door 120 and the front door 130 may be installed to slide open or shut. In another example, one of the top door 120 and the front door 130 may be installed to slide open or shut, and the other may be installed to be pivotally opened or closed. Hereinafter, it is assumed that the top door 120 and the front door 130 are pivotally installed. The top door 120 may be pivotally mounted at a cover frame 150. The front door 120 may be pivotally mounted at a tub 110.

The top door 120 may be provided to open or close the opening 11 of the counter 10.

The front door 130 may be provided with at least one of a detergent container 141 for supplying a detergent into the tub 110 and a rinse container 142 for supplying a rinse into the tub 110.

A display 131 may be provided on the front door 130 to display operation status of the dish washer 100. Specifically, the display 131 may be provided on the upper front of the front door 130. The display 131 may be implemented in a touch screen structure to receive a command from the user.

An operation module 132 may be provided on the front door 130. For example, the operation module 132 may include a power button of the dish washer 100. The operation module 132 may be provided on a side of the display 131.

In another example, at least one of the display 131 and the operation module 132 may be provided on the front door 130.

The dish washer 100 may further include a tub 110 defining a cleaning space 330 therein. The tub 110 may include a front opening 111 that may be opened or closed by the front door 130. The front opening 111 may be larger than the opening 11 formed at the counter 10. The tub 110 may further include a top opening 112 (see FIG. 3) that corresponds to the opening 11 formed through the counter 10. The top door 120 may be provided to open or close the top opening 112 of the tub 110 as well.

The dish washer 100 may further include the cover frame 150. The cover frame 150 may be mounted on the opening 11 of the counter 10. The top door 120 may be installed on the cover frame 150. The cover frame 150 may be mounted on the opening 11 with a portion of the cover frame 150 extending over the nearby counter 10. For example, the cover frame 150 may include a bent portion 156 to be placed on the counter 10. The bent portion 156 of the cover frame 150 may be exposed to the outside. Width w1 of the cover frame 150 including the exposed portion may be greater than width w2 of the opening 11 formed at the counter 10 (see FIG. 3). The width w1 of the cover frame 150 and the width w2 of the opening 11 refer to what are measured in the front-back direction X of the system kitchen 1. In other words, the cover frame 150 may be mounted on the opening 156 with the bent portion of the cover frame 150 supported by the counter 10.

The dish washer 100 may further include at least one basket 161 and 162 arranged in the tub 110 to be put in or pulled out through the front opening 111. The at least one basket 161 and 162 may also be termed a 'front loading basket'. For example, the dish washer 100 may include an upper basket 161 arranged in an upper portion of the tub 110 and a lower basket 162 arranged under the upper basket 161 in the vertical direction of the dish washer 100.

The front door 130 of the dish washer 100 may define the exterior of the system kitchen 1. Specifically, the front door 130 of the dish washer 100 may define the front exterior of the system kitchen 1 together with the cabinet door 21.

The upper end of the front door 130 and the upper end of the cabinet door 21 may be aligned with a reference line R that extends in the width direction Y of the system kitchen 1. The reference line R may be an imaginary line that extends in the width direction Y of the system kitchen 1 to be parallel with the counter 10. As the upper end of the front door 130 and the upper end of the cabinet door 21 are designed to be aligned with each other, the system kitchen 1 may look neat and unified.

The lower end of the front door 130 and the lower end of the cabinet door 21 may also be aligned with a reference line R' that extends in the width direction Y of the system kitchen 1. The reference line R' may be an imaginary line that extends in the width direction Y of the system kitchen 1 to be parallel with the counter 10. That is, the reference lines R and R' are parallel to each other.

The top door 120 of the dish washer 100 may define an exterior of the system kitchen 1. Specifically, the top door 120 of the dish washer 100 may define the top exterior of the system kitchen 1 together with the counter 10. The top door 120 may be provided to have a small gap with the counter 10 in the vertical direction of the system kitchen 1. Otherwise, when the top door 120 has a large gap with the counter 10 in the vertical direction of the system kitchen 1, i.e., when the top door 120 is provided to protrude excessively in the upward direction of the system kitchen 1, the usability may be degraded. For example, the user may happen to collide with the top door 120 that protrudes overly in the upward direction of the system kitchen 1.

Figure 3:
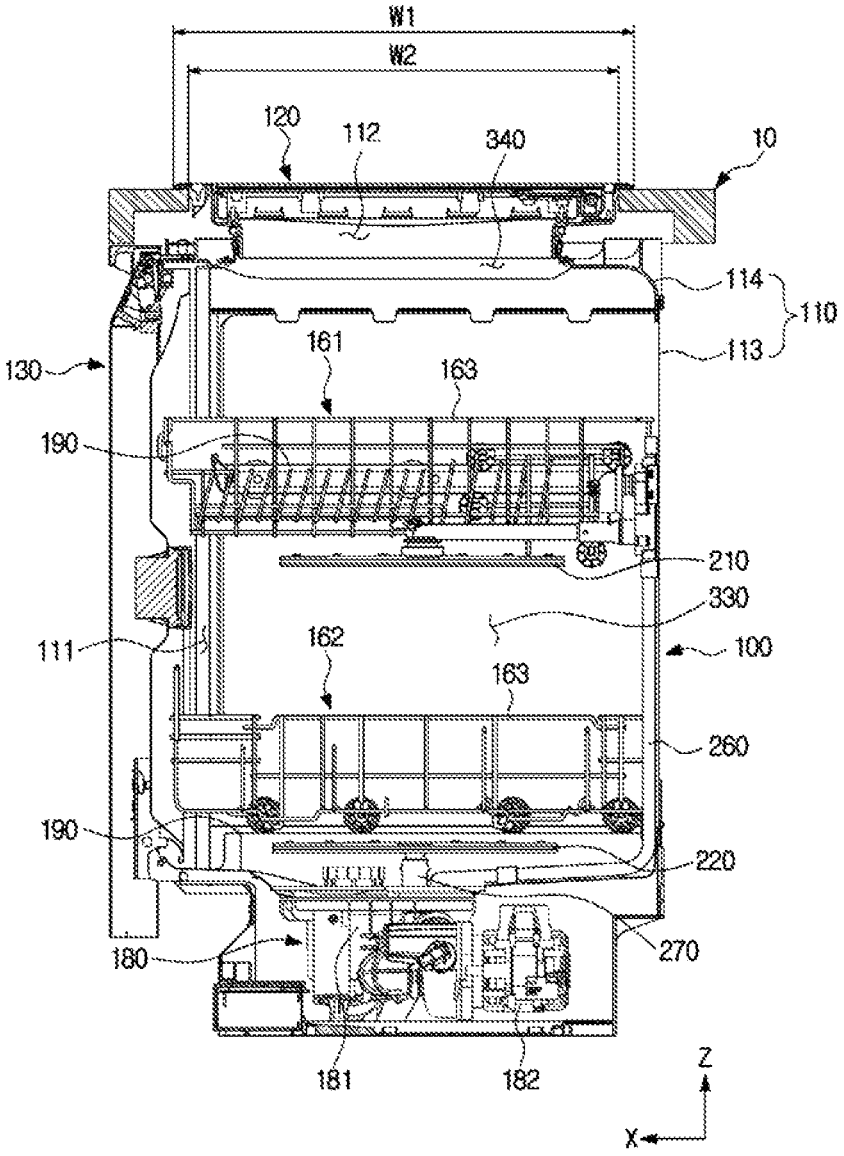
FIG. 3 is a cross-sectional view of the system kitchen of FIG. 1.
Figure 4:
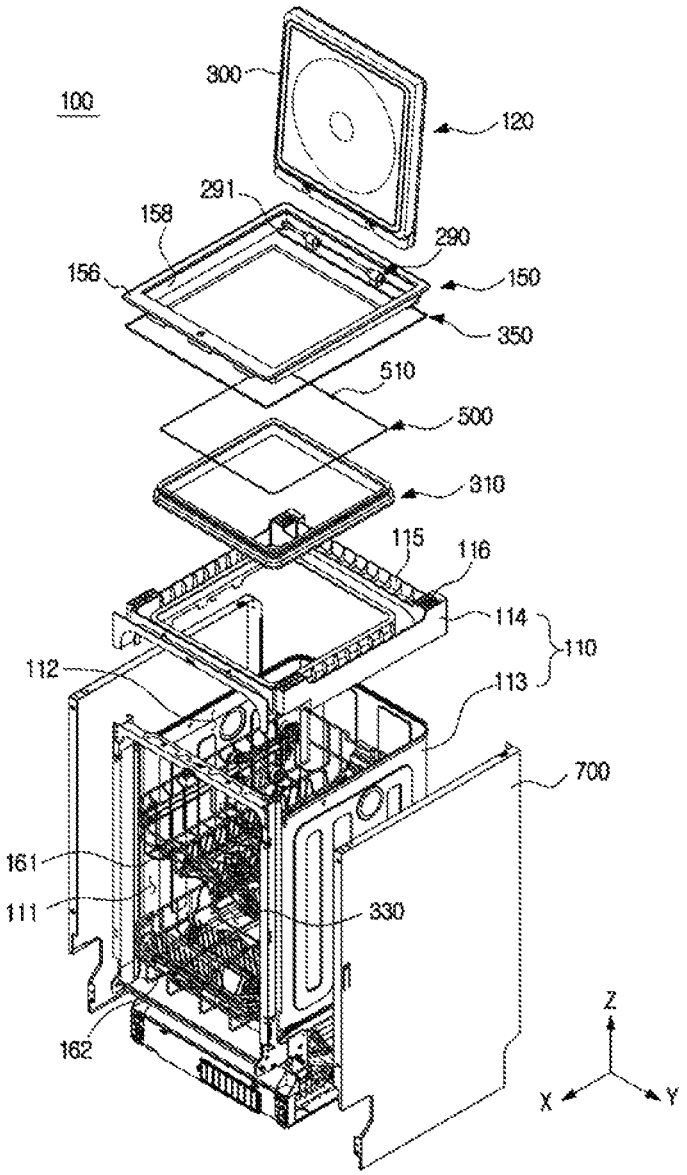
FIG. 4 is an exploded view of a dish washer, according to an embodiment of the disclosure.
Figure 5:
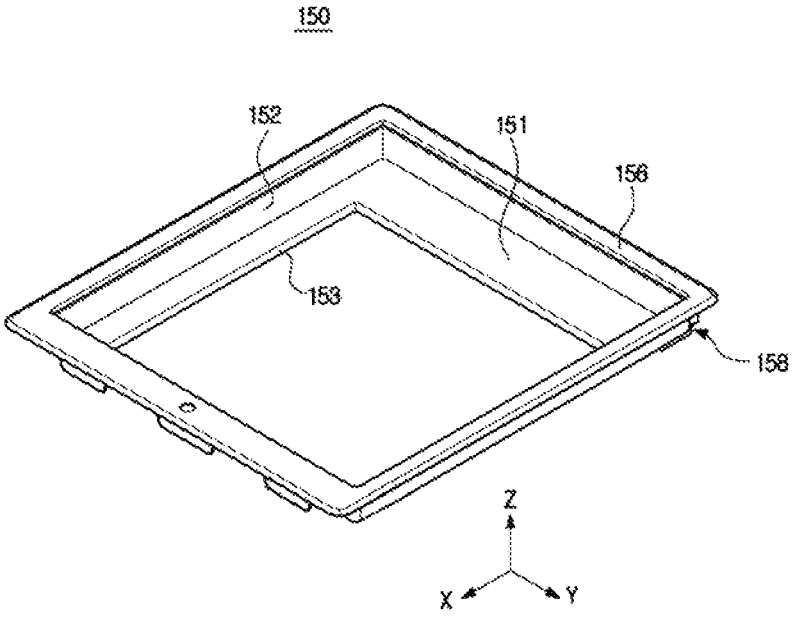
FIG. 5 is a perspective view of a cover frame of a dish washer, according to an embodiment of the disclosure.

FIG. 3 is a cross-sectional view of the system kitchen of FIG. 1 cut along line C-C', and FIG. 4 is an exploded view of a dish washer, according to an embodiment of the disclosure. FIG. 5 is a perspective view of a cover frame of a dish washer, according to an embodiment of the disclosure. In FIG. 4, the front door 130 is not shown.

Referring to FIGS. 3 to 5, the dish washer 100 may include the tub 110 defining the cleaning space 330 therein, and a sump 180 arranged under the tub 110 to collect the water.

The at least one basket 161 and 162 may be arranged in the tub 110 to be moved back and forth in the front-back direction X of the system kitchen 1. Specifically, the at least one basket 161 and 162 may be put in or pulled out along at least one rack 190 that supports the basket 161 or 162 to slide in and out through the front opening 111 of the tub 110.

The at least one basket 161 and 162 may have open top to receive dishes. The at least one basket 161 and 162 may be formed with cross-striped wires 163, allowing the dishes received inside to be easily cleaned by water. In other words, the at least one basket 161 and 162 may be formed with a plurality of wires crossing each other to receive dishes.

The dish washer 100 further includes at least one injector 210 and 220 provided to inject water. The at least one injector 210 and 220 may include the first injector 210 located between the upper basket 161 and the lower basket 162, and the second injector 220 located under the lower basket 162.

The first and second injectors 210 and 220 may be installed to be rotated around the rotation axis so that they may inject water while being rotated.

There may be a heater (not shown) for heating water included in the tub 110, and a heater installation groove (not shown) may be formed in the tub 110. The heater installation groove may be formed on the bottom of the tub 110, and the heater may be installed in the heater installation groove.

The sump 180 may be provided in the middle of the bottom of the tub 110 to collect and pump water. The sump 180 may include a cleaning pump 181 for pumping water at high pressure, and a pump motor 182 for driving the cleaning pump 181.

The cleaning pump 181 pumps the water into the first injector 210 through a first supply pipe 260. The cleaning pump 181 also pumps water into the second injector 220 located in the lower portion through a second supply pipe 270.

The sump 180 may include a turbidity sensor (not shown) for detecting a contamination level of the used water. A controller (not shown) of the dish washer 100 may use the turbidity sensor to detect a contamination level of the used water and then control the number of times to proceed the washing or rinsing course. For example, when the contamination level is high, the controller may increase the number of times to perform the washing or rinsing course, or otherwise, when the contamination level is low, the controller may reduce the number of times to perform the washing or rinsing course.

The dish washer 100 may further include the cover frame 150 mounted on the opening 11 of the counter 10. The cover frame 150 may be mounted on the opening 11 to be separated from the tub 110 in the vertical direction Z of the system kitchen 1. In other words, the cover frame 150 may be mounted on the opening 11 not to overlap the tub 110 in the vertical direction Z of the system kitchen 1.

The cover frame 150 may include a cover frame body 158, and the bent portion 156 bent from the cover frame body 158 to be supported on the counter 10. The bent portion 156 may be formed at the upper end of the cover frame body 158 to be bent outward from the dish washer 100.

The cover frame body 158 may include a rest 151 on which the top door 120 is rested. Specifically, on the rest 151 of the cover frame body 158, a top door hinge 290 including a hinge shaft may be mounted. The top door 120 may be coupled with the top door hinge 290 to pivot on the hinge shaft 291. The hinge shaft 291 of the top door hinge 290 may extend in the width direction Y of the system kitchen 1.

The cover frame body 158 may further include a first wall 152 extending from the rest 151 in the vertical direction Z of the system kitchen 1. Specifically, the first wall 152 may vertically extend from the outer end of the rest 151 to the upward direction of the system kitchen 1. The rest 151 may face the bottom surface of the top door 120, and the first wall 152 may face the sides of the top door 120. In other words, the rest 151 and the first wall 152 may define a top door receiving space to accommodate the top door 120.

The cover frame body 158 may further include a second wall 153 extending from the rest 151 in the vertical direction Z of the system kitchen 1. Specifically, the second wall 153 may vertically extend from the inner end of the rest 151 to the downward direction of the system kitchen 1.

The first wall 152 may extend to be longer than the second wall 153 in the vertical direction Z of the system kitchen 1. That is, the first wall 152 may be longer than the second wall 153 in the vertical direction Z of the system kitchen 1.

The space defined by the first wall 152 may be wider in the width direction Y of the system kitchen 1 than the space defined by the second wall 153.

The dish washer 100 may further include a cover frame sealing member 350. The cover frame sealing member 350 may be arranged between the cover frame 150 and the counter 10. In other words, the cover frame sealing member 350 may be coupled with at least one of the cover frame 150 or the counter 10. The cover frame sealing member 250 may supplement a seal between the cover frame 150 and the counter 10 to prevent an external fluid from coming into the dish washer 100 through a possible gap between the cover frame 150 and the counter 10 or prevent the water inside the tub 110 from leaking out of the dish washer 100 through the gap between the cover frame 150 and the counter 10. The cover frame sealing member 350 may be formed of an elastic material. For example, the cover frame sealing member 350 may be made of e.g., rubber.

The dish washer 100 may further include a top door sealing member 300. The top door sealing member 300 may be coupled with the top door 120. Specifically, the top door sealing member 300 may be arranged in a lower frame 122 of the top door 120. The top door sealing member 300 may supplement a seal between the cover frame 150 and the top door 120 to prevent the water inside the tub 10 from leaking out of the top door 120. The top door sealing member 300 may be formed of an elastic material. For example, the top door sealing member 300 may be made of e.g., rubber.

The dish washer 100 may further include housing panels 700. The housing panels 700 may be arranged on the outside of the tub 110. Specifically, the housing panels 700 may be coupled with either side walls of the tub 110, i.e., left-side wall and right-side wall.

The dish washer 100 may further include a tub body 113, and a tub top 114 mounted on the tub body 113. The tub body 113 and the tub top 114 may be included in the tub 110. The tub top 114 may be coupled onto the top end of the tub body 113. The tub top 114 may have a top opening 112 formed to correspond to the opening 11 of the counter 10.

The tub top 114 may be formed with a material different from that of the tub body 113. For example, the tub top 114 may be formed of polyprophlene (PP) while the tub body 113 may be formed of stainless steel (STS).

The tub top 114 may be provided with a water collector 115. The water collector 115 may be formed to have certain depth along the edge of the tub top 114. The water collector 115 may be formed in the tub top 114 to be located outside a coupling member 310, which will be descried later. When water fails to flow into the tub 110 but flows along the outer wall of the tub 110 because of incomplete coupling, abrasion of the coupling member 310, or some other reasons, it is insanitary and may impose a risk such as the fire. The water collector 115 may be formed on the top end of the tub body 113, i.e., in the tub top 114, collecting water that fails to flow into the tub 110 and guiding the water into the tub 110.

The tub top 114 may be provided with a panel fastener 116. The housing panels 700 may be coupled with the tub 110 to face either side walls of the tub 110. Specifically, the housing panels 700 may be coupled with the panel fastener 116 of the tub top 114 to face either side walls of the tub body 113. The housing panels 700 may be fastened to the panel fastener 116 by a coupling member such as a screw.

The dish washer 100 may further include the coupling member 310. The coupling member 310 may be provided to couple the cover frame 150 to the tub 110. Specifically, the coupling member 310 may couple the cover frame 150 to the tub 110 to be expanded or contracted in the vertical direction Z of the system kitchen 1. The coupling member 310 may be formed of an elastic material. For example, the coupling member 310 may be formed of a material such as rubber. The upper end of the coupling member 310 may be coupled to the cover frame 150 and the lower end of the coupling member 310 may be coupled to the tub 110. In other words, the upper end of the coupling member 310 may be coupled to the cover frame 150 and the lower end of the coupling member 310 may be coupled to the tub top 114.

The coupling member 310 will be described in more detail later.

The dish washer 100 may further include a front door sealing member 320. The front door sealing member 320 may be coupled with the front door 130. The front door sealing member 320 may supplement a seal between the tub 110 and the front door 130 to prevent the water inside the tub 10 from leaking out of the front door 130. The front door sealing member 320 may be formed of an elastic material. For example, the front door sealing member 320 may be made of e.g., rubber.

The top door 120 may include a communication device to communicate with the sensor and the controller to control whether to operate the dish washer 1 according to whether the top door 120 is opened or closed. For example, when the controller is located in a 'lower module' as will be described later, the controller may be electrically connected to the sensor provided at the top door 120 for detecting whether the top door 120 is opened or closed. When the controller is located in the top door 120, the controller of the top door 120 may be electrically connected to a sensor provided at the top door 120 for detecting whether the top door 120 is opened or closed. The controller of the top door 120 may also be electrically connected to various electric parts arranged in the bottom module.

A procedure of installing the built-in type dish washer 100 in the system kitchen 1 will now be described. For convenience of explanation, of components of the dish washer 100, the cover frame 150 and the top door 120 will be collectively referred to as an 'upper module', and the remaining components other than the cover frame 150, the top door 120, and the coupling member 310 will be collectively referred to as the 'lower module'. First, the lower module is mounted in the cabinet 20 in the front-back direction X of the system kitchen 1. Specifically, the lower module is received into the cabinet 20 with the open front in the front-back direction of the system kitchen 1 and fixed to the cabinet 20. The upper module is then mounted through the counter 10. Specifically, the cover frame 150 is mounted on the opening 11 of the counter 10 and the top door 120 is installed at the cover frame 150. The upper module and the lower module may be coupled by the coupling member 310. Specifically, the cover frame 150 of the upper module and the tub 110 of the lower module may be coupled by the coupling member 310. How the cover frame 150 and the tub 110 are coupled by the coupling member 310 will be described in detail later.

Figure 6:
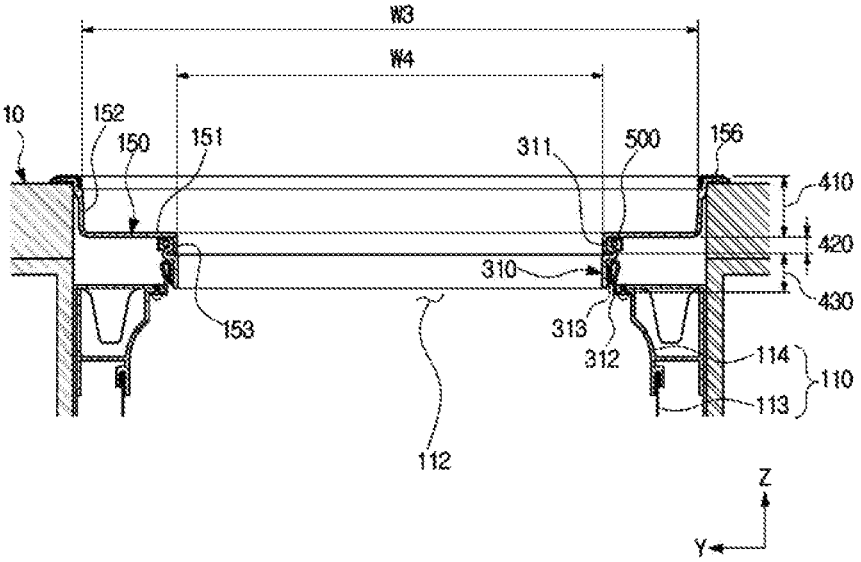
FIG. 6 is a cross-sectional view illustrating connections between a cover frame, a coupling member, and a tub in a dish washer, according to an embodiment of the disclosure.

FIG. 6 is a cross-sectional view illustrating connections between a cover frame, a coupling member, and a tub in a dish washer, according to an embodiment of the disclosure. In FIG. 6, the top door 120 is not shown.

Referring to FIG. 6, the cover frame 150 may be mounted on the opening 11 to be separated from the tub 110 in the vertical direction Z of the dish washer 100. The reason that the cover frame 150 is placed not to overlap with the tub 110 in the vertical direction of the dish washer 100 is to help easy repair service on the dish washer 100. Specifically, on an occasion when the cover frame 150 is placed to overlap the tub 110 in the vertical direction Z of the dish washer 100, when the tub 110 and the cover frame 150 needs to be separated for a repair service, it is cumbersome to separate the cover frame 150 from the counter 10. In this case, the counter 10 or the cover frame 150 might be damaged while the cover frame 150 is being separated from the counter 10. For this reason, the cover frame 150 may be placed to be separated from the tub 110 in the vertical direction of the dish washer 100

The coupling member 310 may be expanded or contracted in the vertical direction Z of the dish washer 100.

The coupling member 310 may couple the cover frame 150 to the tub 110. Specifically, the coupling member 310 may couple the cover frame 150 to the tub top 114.

The coupling member 310 may include a first end 311 coupled to the cover frame 150 and a second end 312 coupled to the tub 110. The second end 312 may be placed outside the first end 311. The first end 311 of the coupling member 310 may be placed outside the cover frame 150 to cover the outer surface of the cover frame 150. Specifically, the first end 311 of the coupling member 310 may be placed outside the cover frame 150 to cover at least a portion of the second wall 153 of the cover frame 150. The second end 312 of the coupling member 310 may be coupled onto the inner surface of the tub 110 after passing through the top opening 11 of the tub 110. Specifically, the second end 312 of the coupling member 310 may be coupled onto the inner surface of the tub top 114 after passing through the top opening 11 of the tub 114.

The coupling member 310 may have the form of a closed loop. The form of the coupling member 310 is not, however, limited thereto, and may be variously modified.

The coupling member 310 may include at least one bent portion 313. For example, the coupling member 310 may be shaped like a diaphragm.

The coupling member 310 may be provided to define a space 430 located between the cover frame 150 and the tub 110 in the vertical direction Z of the dish washer 100. The space 430 defined by the coupling member 310 may also be termed a 'third space'.

The cover frame 150 may include a first space 410. Specifically, the first space 410 may be defined by the rest 151 and the first wall 152. The top door 120 may be rested in the first space 410.

The cover frame 150 may further include a second space 420. The second space 420 may be located under the first space 410 in the vertical direction Z of the dish washer 100. Specifically, the second space 420 may be defined by the rest 151 and the second wall 153.

Width w3 of the first space 410 may be larger than width w4 of the second space 420.

The third space 430 defined by the coupling member 310 may be located between the second space 420 of the cover frame 150 and the tub 110 in the vertical direction of the dish washer 100. Specifically, the third space 430 defined by the coupling member 310 may be located between the second space 420 of the cover frame 150 and the tub top 114 in the vertical direction of the dish washer 100.

The third space 430 defined by the coupling member 310 may vary by thickness of the counter 10. Specifically, the third space 430 defined by the coupling member 310 may vary by thickness of the counter 10 in the vertical direction of the dish washer 100. This will be described later.

Figure 7:
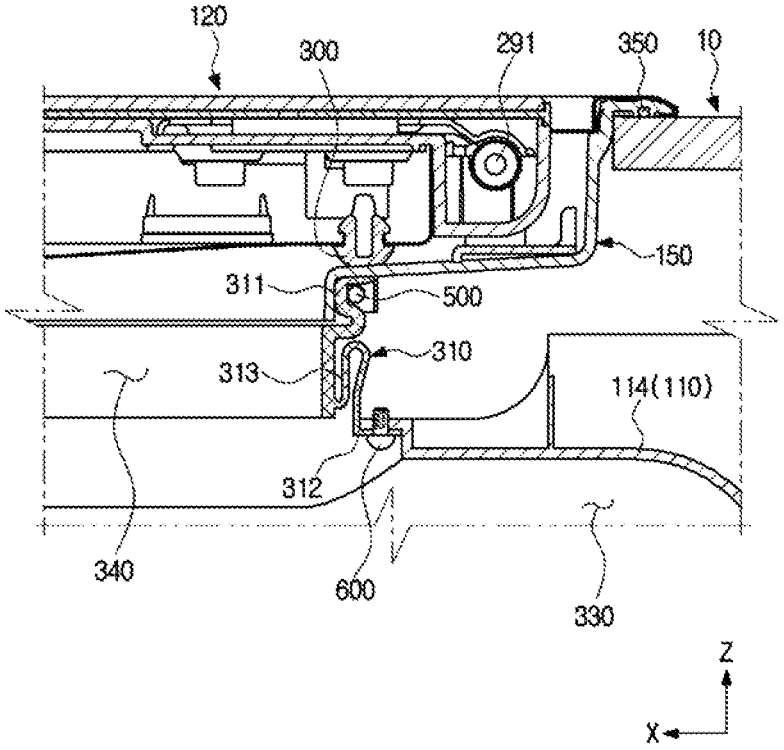
FIG. 7 is an enlarged view of a portion of FIG. 3.

FIG. 7 is an enlarged view of a portion of FIG. 3.

Referring to FIG. 7, the first end 311 of the coupling member 310 may be coupled to the cover frame 150 and the second end 312 of the coupling member 310 may be coupled to the tub 110.

The dish washer 100 may further include a wire 500 that couples the coupling member 310 with the cover frame 150. Specifically, the wire 500 may couple the first end 311 of the coupling member 310 to the outer surface of the cover frame 150. The wire 500 may be placed along the edge of the coupling member 310. The wire 500 may include a knot 510 (see FIG. 4). The first end 311 of the coupling member 310 may be fixed to the cover frame 150 by the wire 500.

The dish washer 100 may further include a fastening member 600 for coupling the coupling member 310 to the tub 110. Specifically, the fastening member 600 may couple the second end 312 of the coupling member 310 to the inner surface of the tub 110. In other words, the fastening member 600 may couple the second end 312 of the coupling member 310 to the inner surface of the tub top 114. In this case, the fastening member 600 may fix the second end 312 of the coupling member 310 to the inner surface of the tub 110 in the vertical direction Z of the dish washer 100. The fastening member 600 may fix the second end 312 of the coupling member 310 to the inner surface of the tub 110 from the inside of the tub 110 in the upward direction of the dish washer 110. For example, the fastening member 600 may include a screw.

Figure 8A:
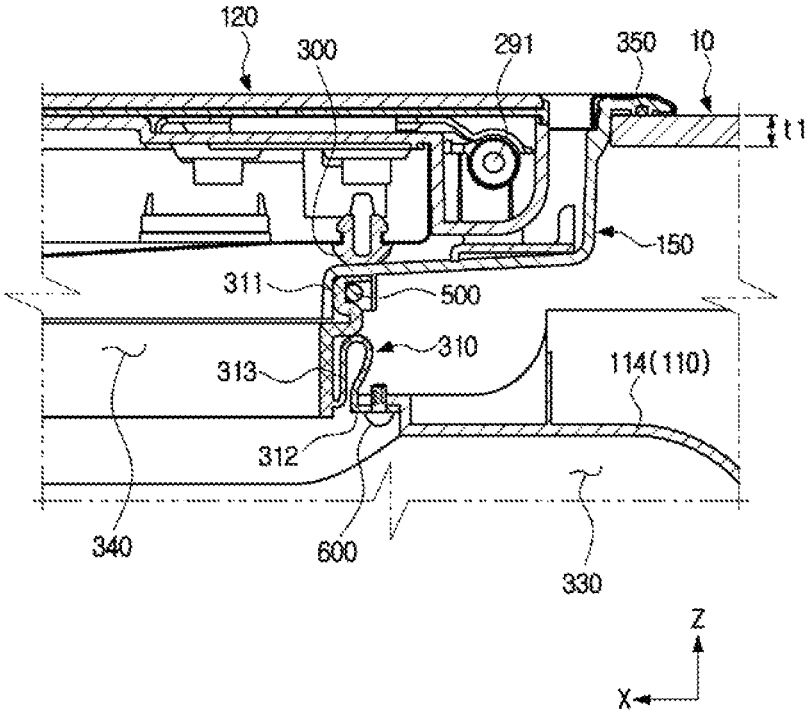
FIGS. 8A and 8B show a change in form of a coupling member of a dish washer by the thickness of a counter, according to an embodiment of the disclosure.
Figure 8B:
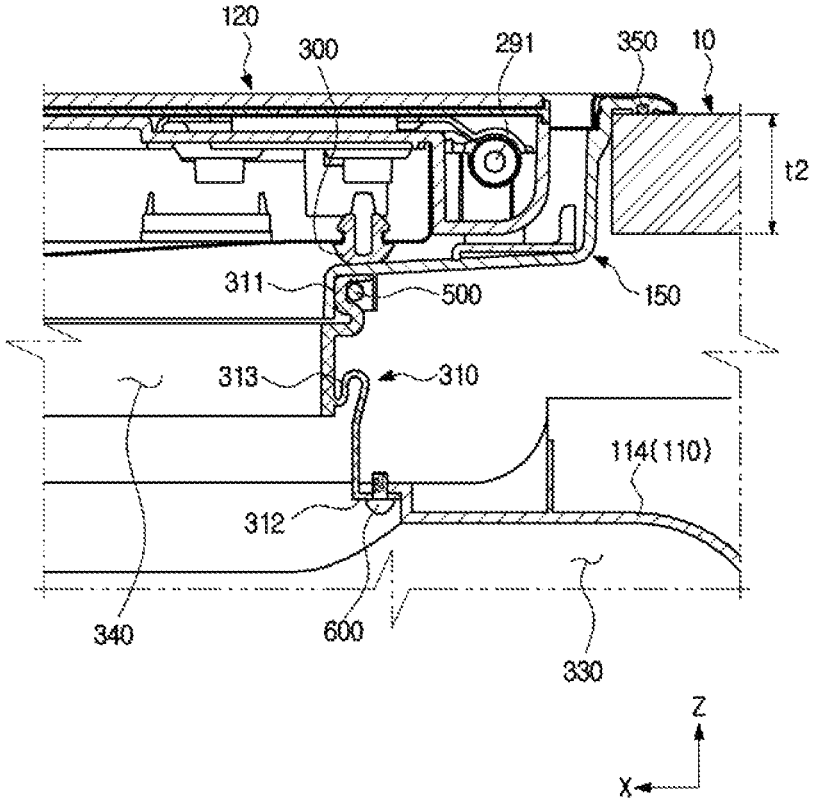

FIGS. 8A and 8B show a change in form of a coupling member of a dish washer according to the thickness of a counter, according to an embodiment of the disclosure. FIG. 8A shows a form of the coupling member 310 in a case that the counter 10 has thin thickness t1, and FIG. 8B shows a form of the coupling member 310 in a case that the counter 10 has thick thickness t2.

Referring to FIG. 8A, in the case that the thickness t of the counter 10 is thin, a distance between the cover frame 150 and the tub 110 is short in the vertical direction Z of the dish washer 100. In other words, with the counter 10 having thin thickness t1, a degree of expansion of the coupling member 310 in the vertical direction Z of the dish washer 100 may be small. From another perspective, on the occasion when the counter 10 has the thin thickness t1, the third space 430 defined by the coupling member 310 may be small.

Referring to FIG. 8B, in the case that the counter 10 has the thick thickness t2, a distance between the cover frame 150 and the tub 110 is long in the vertical direction Z of the dish washer 100. In other words, with the counter 10 having the thick thickness t2, a degree of expansion of the coupling member 310 in the vertical direction Z of the dish washer 100 may be large. From another perspective, on the occasion when the counter 10 has the thick thickness t2, the third space 430 defined by the coupling member 310 may be large.

As such, the thick thickness of the counter 10 may increase the third space 430 defined by the coupling member 310 and the thin thickness of the counter 10 may reduce the space 430.

Figure 9:
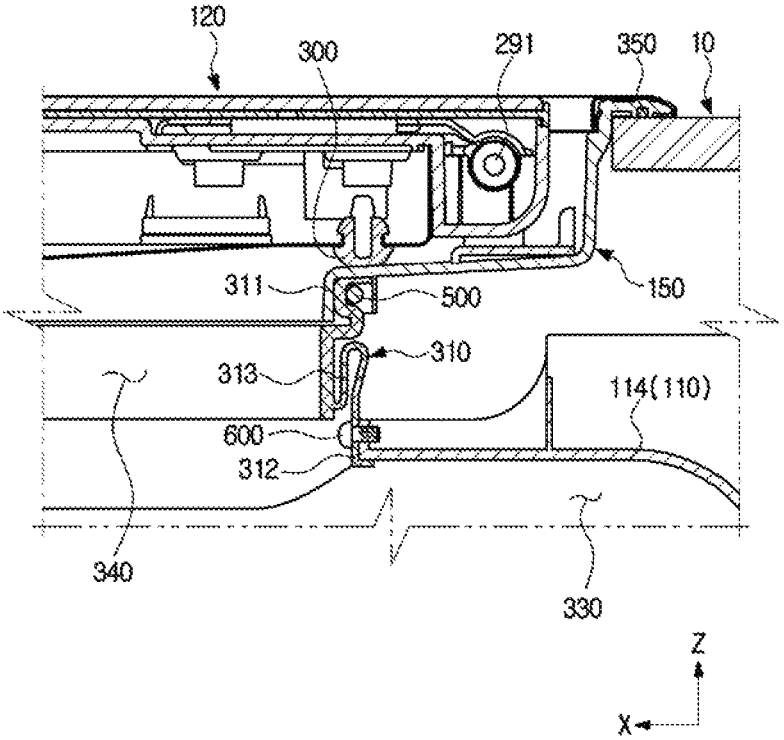
FIG. 9 shows a coupling structure of a coupling member of a dish washer in a first modification, according to an embodiment of the disclosure.

FIG. 9 shows a coupling structure of a coupling member of a dish washer in a first modification, according to an embodiment of the disclosure.

Referring to FIG. 9, the first end 311 of the coupling member 310 may be coupled to the cover frame 150 and the second end 312 of the coupling member 310 may be coupled to the tub 110.

The first end 311 of the coupling member 310 may be fixed to the cover frame 150 by the wire 500. The wire 500 is described above in connection with FIG. 7, so the description thereof will not be repeated.

The second end 312 of the coupling member 310 may be coupled to the tub 110 by the fastening member 600. Specifically, the fastening member 600 may couple the second end 312 of the coupling member 310 to the inner surface of the tub 110. In other words, the fastening member 600 may couple the second end 312 of the coupling member 310 to the inner surface of the tub top 114. In this case, the fastening member 600 may fix the second end 312 of the coupling member 310 to the inner surface of the tub 110 in a direction perpendicular to the vertical direction Z of the dish washer 100. The fastening member 600 may fix the second end 312 of the coupling member 310 to the inner surface of the tub 110 from the inside of the tub 110 in the left-right direction Y or front-back direction X of the dish washer 110. For example, the fastening member 600 may include a screw.

Figure 10:
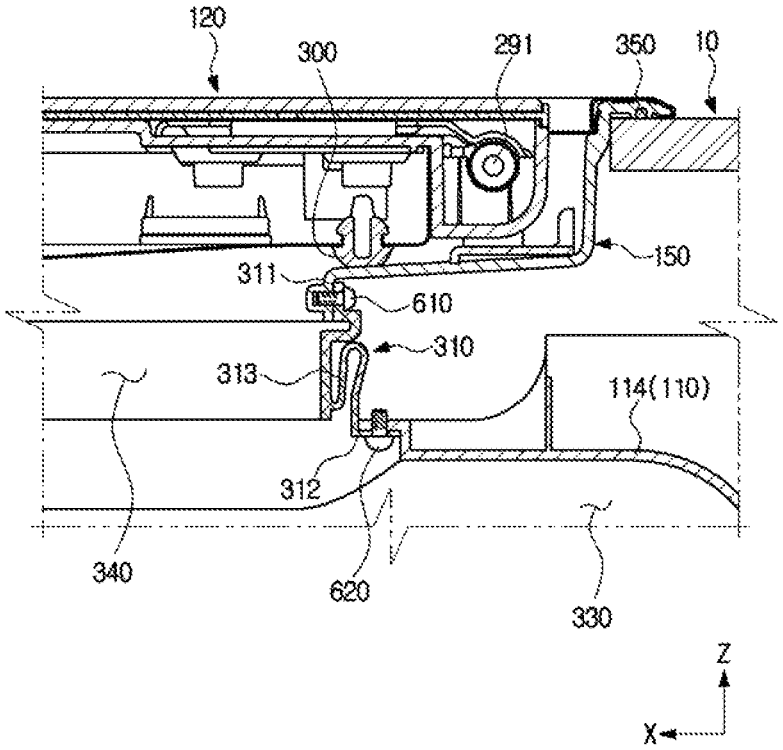
FIG. 10 shows a coupling structure of a coupling member of a dish washer in a second modification, according to an embodiment of the disclosure.

FIG. 10 shows a coupling structure of a coupling member of a dish washer in a second modification, according to an embodiment of the disclosure.

Referring to FIG. 10, the first end 311 of the coupling member 310 may be coupled to the cover frame 150 and the second end 312 of the coupling member 310 may be coupled to the tub 110.

The dish washer 100 may further include a first fastening member 610 that couples the coupling member 310 with the cover frame 150. Specifically, the first fastening member 610 may couple the first end 311 of the coupling member 310 to the outer surface of the cover frame 150. In this case, the first fastening member 610 may fix the first end 311 of the coupling member 310 to the outer surface of the cover frame 150 in a direction perpendicular to the vertical direction Z of the dish washer 100. The first fastening member 610 may fix the first end 311 of the coupling member 310 to the outer surface of the cover frame 150 from outside of the cover frame 150 in the left-right direction Y or front-back direction X of the dish washer 110. For example, the first fastening member 610 may include a screw.

The dish washer 100 may further include a second fastening member 620 for coupling the coupling member 310 to the tub 110. Specifically, the second fastening member 620 may couple the second end 312 of the coupling member 310 to the inner surface of the tub 110. In other words, the second fastening member 620 may couple the second end 312 of the coupling member 310 to the inner surface of the tub top 114. In this case, the second fastening member 620 may fix the second end 312 of the coupling member 310 to the inner surface of the tub 110 in the vertical direction Z of the dish washer 100. The second fastening member 620 may fix the second end 312 of the coupling member 310 to the inner surface of the tub 110 from the inside of the tub 110 in the upward direction of the dish washer 110. For example, the second fastening member 620 may include a screw.

Figure 11:
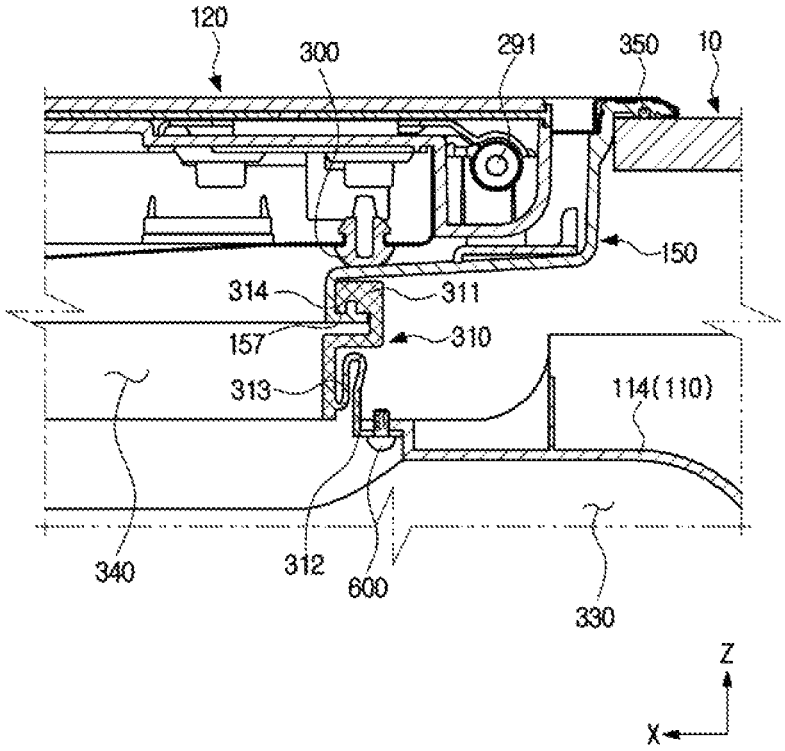
FIG. 11 shows a coupling structure of a coupling member of a dish washer in a third modification, according to an embodiment of the disclosure.

FIG. 11 shows a coupling structure of a coupling member of a dish washer in a third modification, according to an embodiment of the disclosure.

Referring to FIG. 11, the first end 311 of the coupling member 310 may be coupled to the cover frame 150 and the second end 312 of the coupling member 310 may be coupled to the tub 110.

The cover frame 150 may include a coupling groove 157. Specifically, the coupling groove 157 may be formed along the edge of the cover frame 150 at one end of the cover frame toward the tub 110. The one end of the cover frame 150 toward the tub 110 may be bent outward from the cover frame 150, and the coupling groove 175 may be formed at the end of the cover frame 150 bent outward from the cover frame 150. The coupling groove 157 of the cover frame 150 may be opened in the upward direction of the dish washer 100.

The coupling member 310 may include a coupler 314. The coupler 314 may be formed at the first end 311 of the coupling member 310 to be coupled into the coupling groove 157.

The first end 311 of the coupling member 310 may be fixed to the cover frame 150 by the coupling between the coupler 314 and the coupling groove 157.

The second end 312 of the coupling member 310 may be coupled to the inner surface of the tub 110 by the fastening member 600. The fastening member 600 may fix the second end 312 of the coupling member 310 to the inner surface of the tub 110 from the inside of the tub 110 in the upward direction of the dish washer 110. The fastening member 600 is described above in connection with FIG. 7, so the description thereof will not be repeated.

Figure 12:
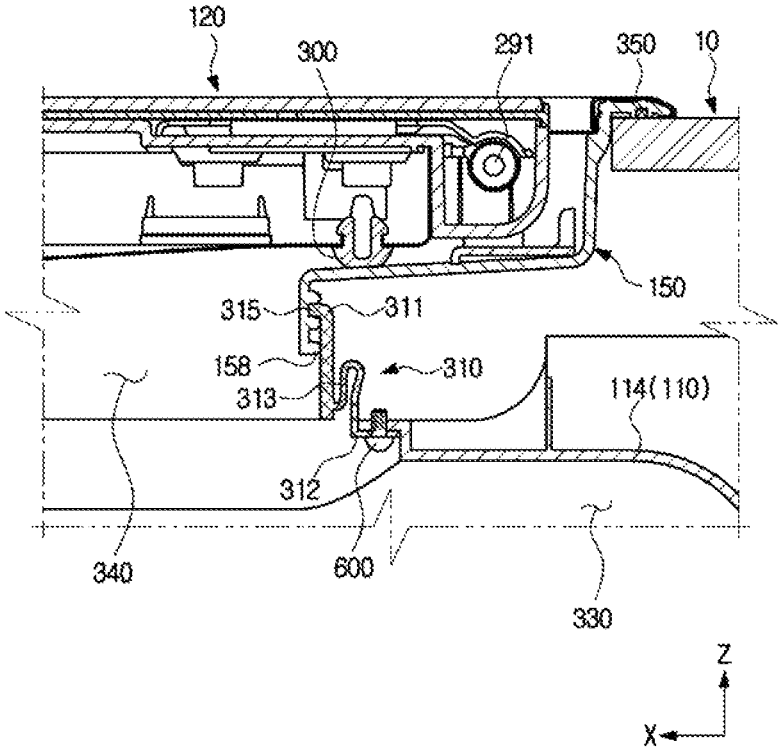
FIG. 12 shows a coupling structure of a coupling member of a dish washer in a fourth modification, according to an embodiment of the disclosure.

FIG. 12 shows a coupling structure of a coupling member of a dish washer in a fourth modification, according to an embodiment of the disclosure.

Referring to FIG. 12, the first end 311 of the coupling member 310 may be coupled to the cover frame 150 and the second end 312 of the coupling member 310 may be coupled to the tub 110.

The cover frame 150 may include a plurality of projections 158. Specifically, the plurality of projections 158 may be formed on the outer surface of the cover frame 150 to be separated from one another in the vertical direction Z of the dish washer 100.

The coupling member 310 may include latches 315. The latches 315 may be formed at the first end 311 of the coupling member 310 to be caught in between the plurality of projections 158.

The first end 311 of the coupling member 310 may be fixed to the cover frame 150 by the coupling between the latches 315 and the plurality of projections 158. When the counter 10 is thin, the distance between the cover frame 150 and the tub 110 is short in the vertical direction of the dish washer 100, and the latches 315 of the coupling member 310 may be caught in between the plurality of projections 158 located up in the vertical direction Z of the dish washer 100. On the other hand, when the counter 10 is thick, the distance between the cover frame 150 and the tub 110 is long in the vertical direction of the dish washer 100, and the latches 315 of the coupling member 310 may be caught in between the plurality of projections 158 located down in the vertical direction Z of the dish washer 100.

How the coupling member 310 couples the cover frame 150 to the tub 110 is not, however, limited thereto, but may be variously changed.

Figure 13:
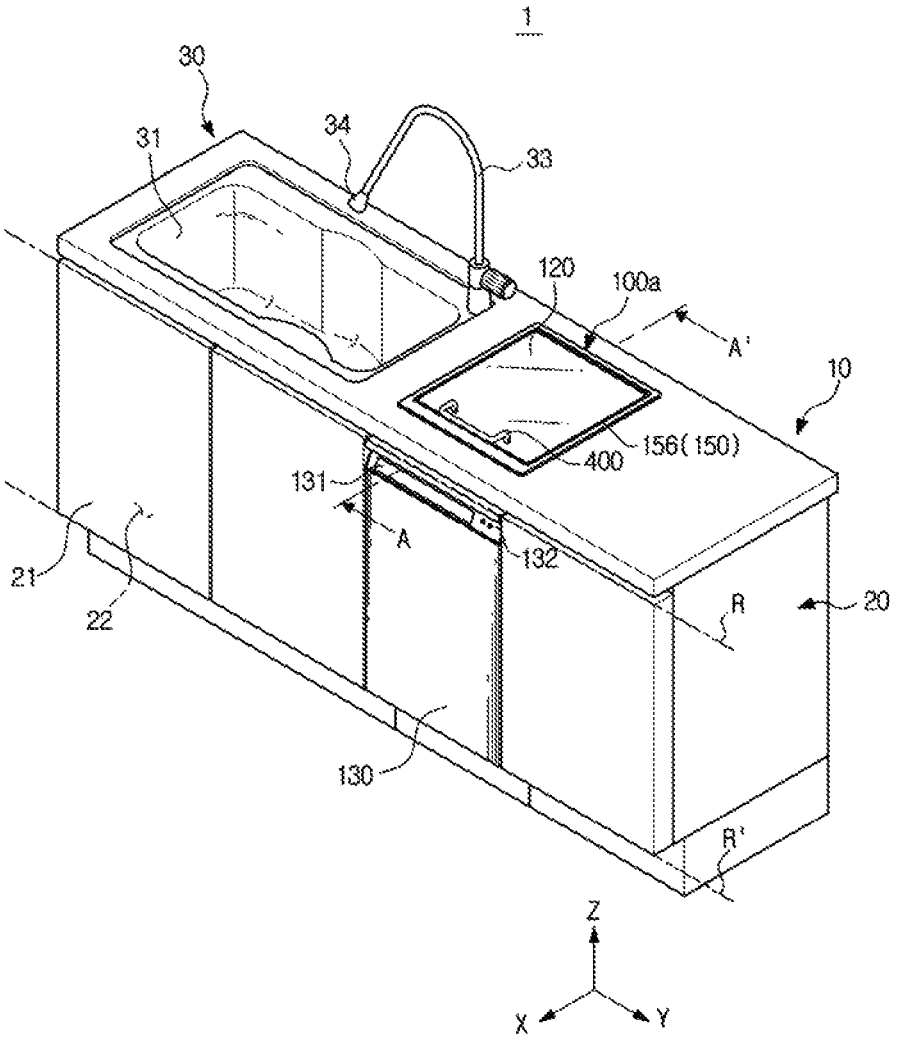
FIG. 13 shows a system kitchen with a built-in dish washer installed therein, according to another embodiment of the disclosure.
Figure 14:
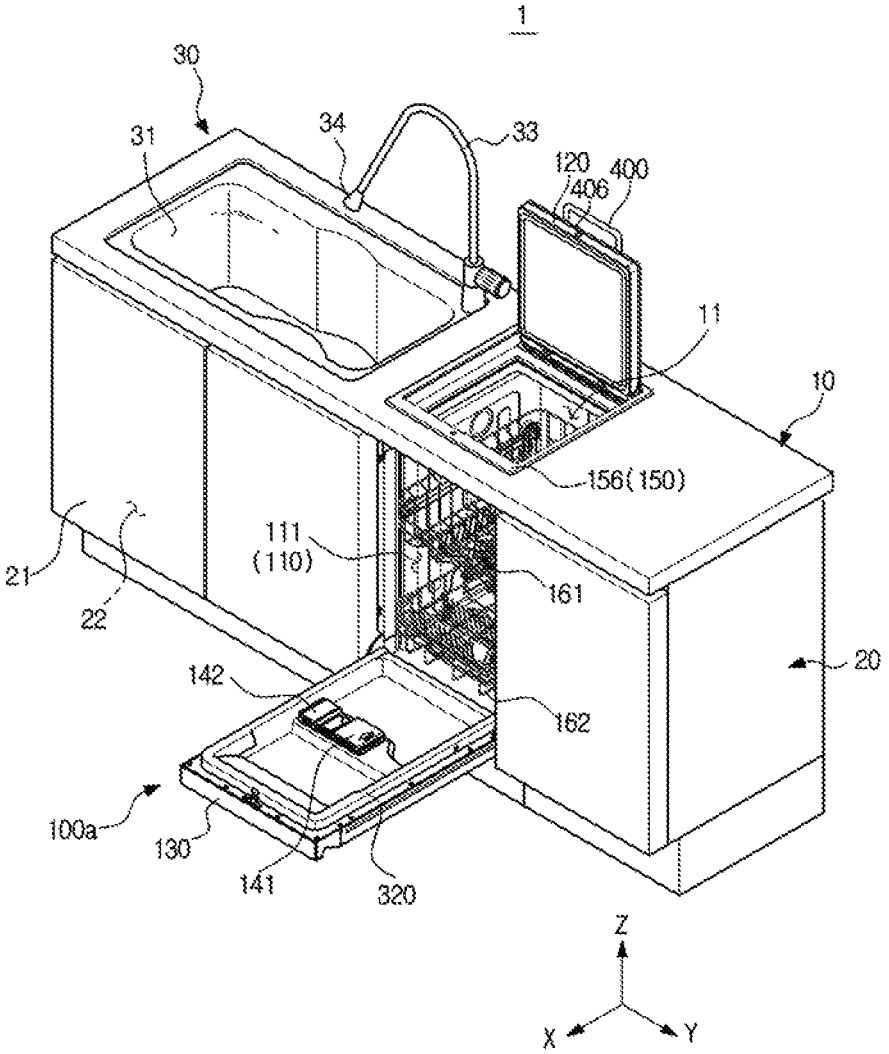
FIG. 14 shows the built-in dish washer of the system kitchen of FIG. 13 with both front and top doors of the dish washer open.
Figure 15:
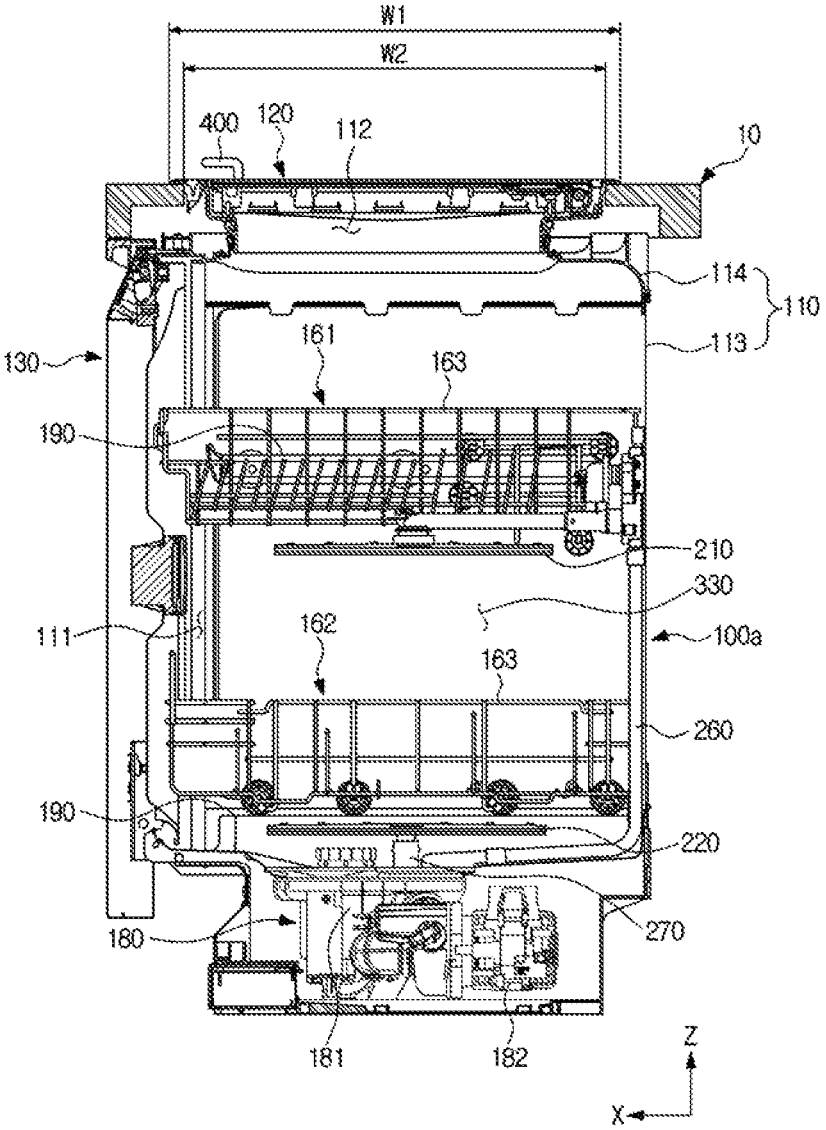
FIG. 15 is a cross-sectional view of the system kitchen of FIG. 13 cut along line A-A'.
Figure 16:
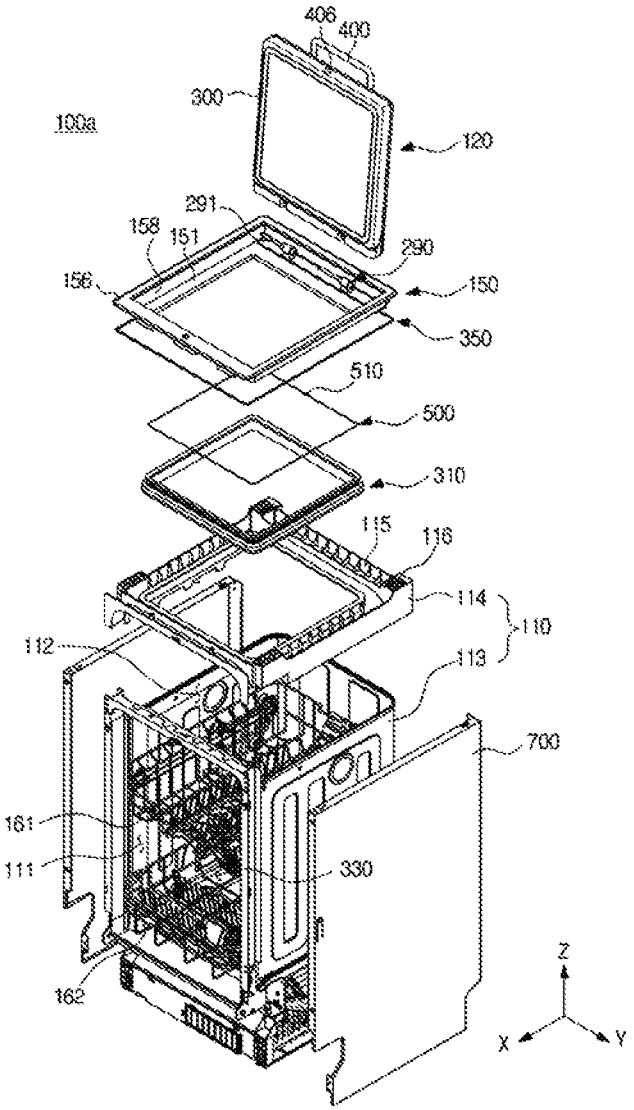
FIG. 16 is an exploded view of a dish washer, according to another embodiment of the disclosure.
Figure 17:
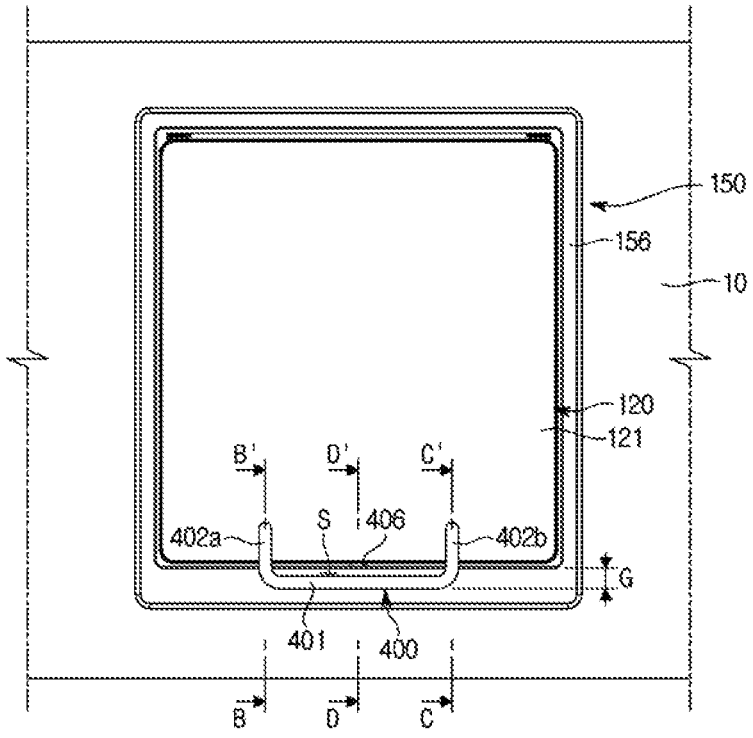
FIG. 17 is a top view of a portion of the system kitchen of FIG. 13.
Figure 18:
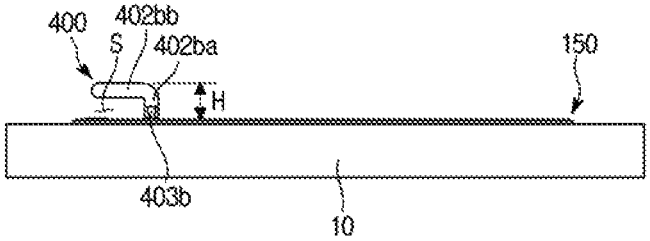
FIG. 18 shows a counter, a cover frame, and a top door of the system kitchen of FIG. 13 viewed from the right.
Figure 19:
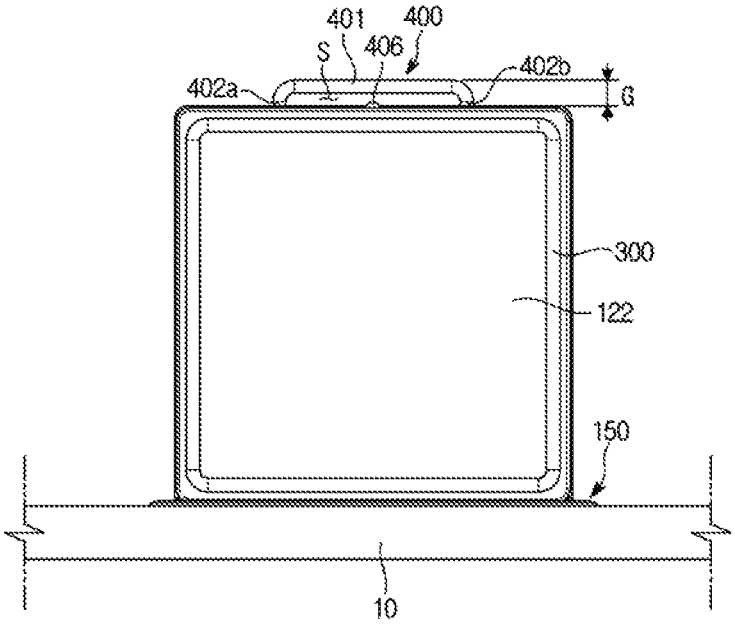
FIG. 19 is a front view of the system kitchen of FIG. 13 with the top door open.

FIG. 13 shows a system kitchen with a built-in dish washer installed therein, according to an embodiment of the disclosure, and FIG. 14 shows the built-in dish washer of the system kitchen of FIG. 13 with both front and top doors of the dish washer open. FIG. 15 is a cross-sectional view of the system kitchen of FIG. 13 cut along line A-A, and FIG. 16 is an exploded view of a dish washer, according to another embodiment of the disclosure. FIG. 17 is a top view of a portion of the system kitchen of FIG. 13, and FIG. 18 shows a counter, a cover frame, and a top door of the system kitchen of FIG. 13 viewed from the right. FIG. 19 is a front view of the system kitchen of FIG. 13 with the top door open. What are overlapped with FIGS. 1 and 4 will be omitted in the following description.

Referring to FIGS. 13 to 19, the top door 120 may include a handle 400 provided for the user to grip to open or close the top door 120. The handle 400 may be arranged at the other end of the top door 120 opposite one end at which a rotation axis of the top door 120 lies. Specifically, the handle 400 may be arranged at the front end of the top door 120, which is opposite the rear end of the top door 120 at which the top door hinge 290 is arranged. The handle 400 may include a grip part 401 and extension parts 402*a* and 402*b*.

The grip part 401 is a part to be gripped by the user, running substantially in the left-right direction. The grip part 401 may extend from end to end of the extension parts 402*a* and 402*b*. The grip part 401 may be arranged forward further than the front end of the top door 120 by a certain distance. Specifically, the front end of the grip part 401 may be arranged a holding distance forward from the front end of the top door 120.

Otherwise, when a portion of the handle gripped by the user is arranged behind the front end of the door, the handle is hidden from the view of the user while the top door is opened, in which case the user might not easily grip the handle and have to close the top door by holding the top door itself.

In the embodiment of the disclosure, the handle 400 of the dish washer 100*a* protrudes forward by the holding distance G from the front end of the top door 120, so the user may easily grip the grip part 401 protruding forward from the front end of the top door 120 to close the top door 120.

The grip part 401 may lie above the counter 10. The grip part 401 may be arranged to be separated from the top surface of the top door 120 by a certain distance above. Specifically, the top end of the grip part 401 may be separated from the top end of the top door 120 by holding height H. The top end of the top door 120 may be substantially aligned with the top surface of the bent portion 156 of the cover frame 150, so the grip part 401 may also be separated from the top surface of the bent portion 156 by the holding height H.

As the grip part 401 is separated from the top surface of the bent portion 156 of the cover frame 150 by the holding height H and protrudes forward from the front end of the top door 120 by the holding distance G, a grip space S may be formed between the handle 400, the top door 120, and the cover frame 150. The user may easily grip the handle 400 through the grip space S.

The extension parts 402*a* and 402*b* may be coupled to the top door 120. The extension parts 402*a* and 402*b* may extend from the top surface of the top door 120 to the grip part 401. The extension parts 402*a* and 402*b* may include first and second extension parts 402*a* and 402*b*.

The first extension part 402*a* may extend from the left end of the grip part 401 to the top door 120. The first extension part 402*a* may be coupled to the left end of the grip part 401. The first extension part 402*a* may include a first extension 402*aa* extending upward from the top surface of the top door 120 and a second extension 402*ab* extending forward from the first extension 402*aa* to the grip part 401.

The second extension part 402*b* may extend from the right end of the grip part 401 to the top door 120. The second extension part 402*b* may be coupled to the right end of the grip part 401. The second extension part 402*b* may include a first extension 402*ba* extending upward from the top surface of the top door 120 and a second extension 402*bb* extending forward from the first extension 402*ba* to the grip part 401.

Although in this embodiment of the disclosure the extension parts 402*a* and 402*b* includes the first and second extension parts 402*a* and 402*b*, there may be one extension part or three or more extension parts as long as the extension part(s) extends from the top surface of the top door 120 to the grip part 401.

Figure 20:
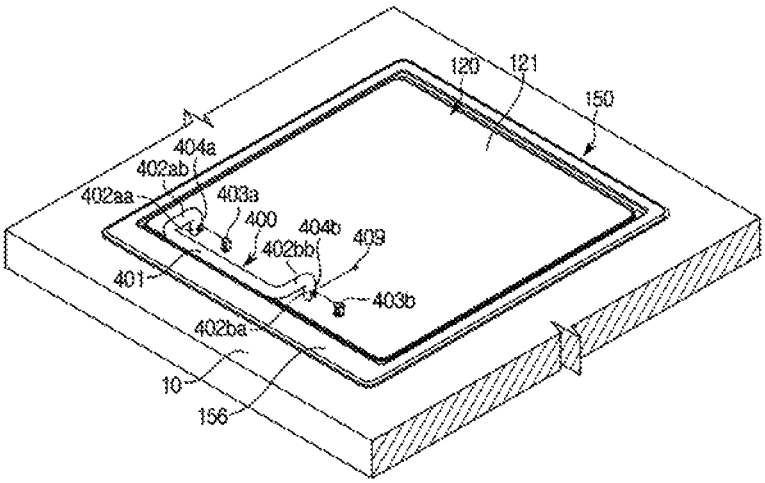
FIG. 20 shows a handle being attached to the top door of the system kitchen of FIG. 13.
Figure 21:
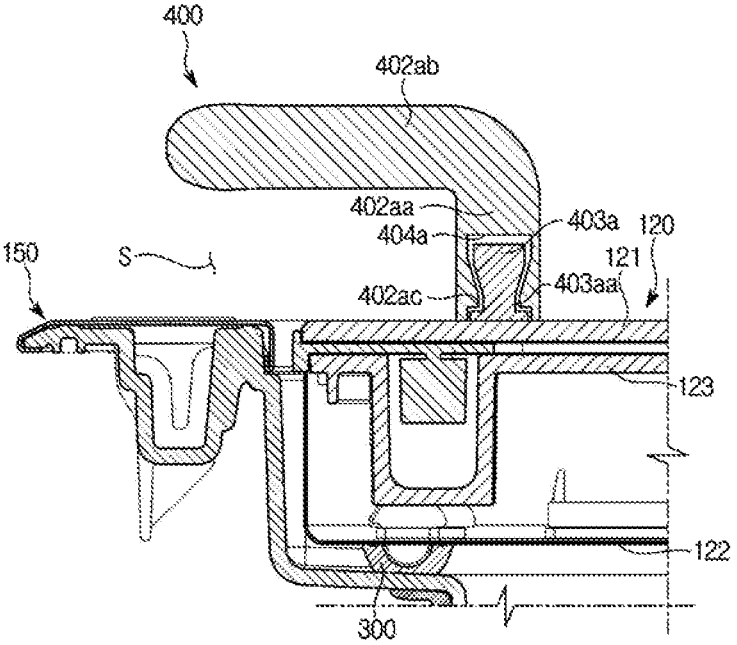
FIG. 21 is a cross-sectional view along line B-B' marked in FIG. 17.
Figure 22:
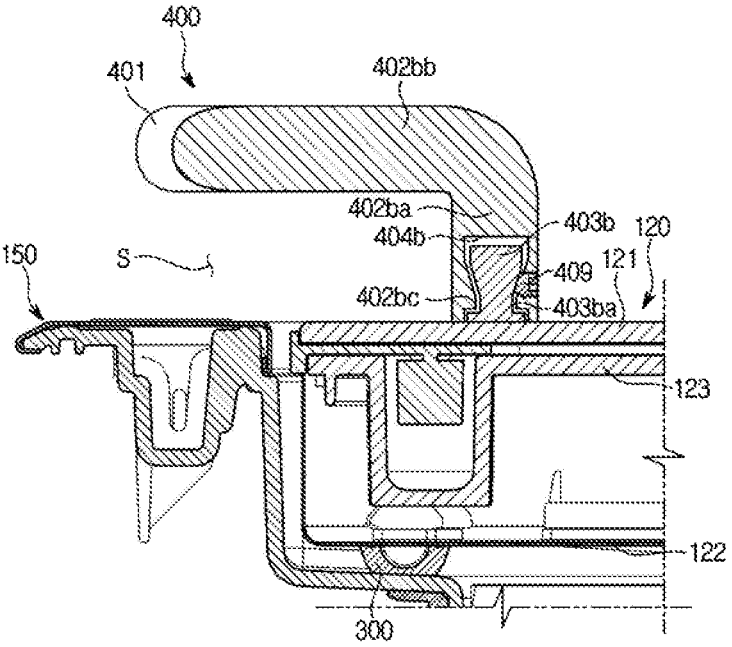
FIG. 22 is a cross-sectional view along line C-C' marked in FIG. 17.

FIG. 20 shows a handle being attached to the top door of the system kitchen of FIG. 13, and FIG. 21 is a cross-sectional view along line B-B' marked in FIG. 20. FIG. 22 is a cross-sectional view along line C-C' marked in FIG. 20.

Referring to FIGS. 20 to 22, the handle 400 may be coupled with the top surface of the top door 120 while sliding to the right. For example, the extension parts 402*a* and 402*b* of the handle 400 may be coupled with the top door 120 by sliding to a direction perpendicular to a direction in which the top door 120 is opened or closed. Specifically, the handle 400 may be coupled with the top door 120 as coupling projections 403*a* and 403*b* protruding upward from the top frame 121 of the top door 120 slide into first insertion recess 404*a* and second insertion recess 404*b* provided in the extension parts 402*a* and 402*b*. The coupling projections 403*a* and 403*b* may include the first coupling projection 403*a* to be coupled with the first insertion recess 404*a* of the first extension part 402*a* and the second coupling projection 403*b* to be coupled with the second insertion recess 404*b* of the second extension part 402*b*.

The first extension part 402*a* may include the first insertion recess 404*a* to which the first coupling projection 403*a* is inserted. The first insertion recess 404*a* may be formed with a portion of the left surface of the first extension part 402*a* sunken for the first coupling projection 403*a* to be moved to the left and inserted thereto. For example, the first insertion recess 404*a* may be formed with a portion of the left surface of the first extension part 402*a* sunken for sliding coupling with the first coupling projection 403*a*.

Specifically, referring to FIG. 21, the shape of the cross-section of the first insertion recess 404*a* may be almost similar to the shape of the cross-section of the first coupling projection 403*a*, when viewed from the direction to which the first coupling projection 403*a* slides to be inserted to the first insertion recess 404*a*. In this case, however, for smooth insertion, the size of the cross-section of the first coupling projection 403*a* may be a bit smaller than that of the first insertion recess 404*a*.

The first insertion recess 404*a* may include a projection 402*ac* for preventing the first extension part 402*a* from being deviated in the vertical direction while coupled with the first coupling projection 403*a*. The projection 402*ac* may protrude to the inside of the first insertion recess 404*a*. The projection 402*ac* may be inserted to a coupling recess 403*aa* of the first coupling projection 403*a* formed along a perpendicular direction to the direction in which the top door 120 is opened or closed. The coupling recess 403*aa* may be sunken to the inside of the first coupling projection 403*a*. The coupling recess 403*aa* may be provided to have a similar shape to the projection 402*ac*.

The second extension part 402*b* may include the second insertion recess 404*b* to which the second coupling projection 403*b* is inserted. The second insertion recess 404*b* may be formed with a portion of the left surface of the second extension part 402*b* sunken for the second coupling projection 403*b* to be moved to the left and inserted thereto. For example, the first insertion recess 404*a* may be formed with a portion of the left surface of the first extension part 402*a* sunken for sliding coupling with the first coupling projection 403*a*.

Specifically, referring to FIG. 22, the shape of the cross-section of the second insertion recess 404*b* may be almost similar to the shape of the cross-section of the second coupling projection 403*b* when viewed from the direction to which the second coupling projection 403*b* slides to be inserted to the second insertion recess 404*b*. In this case, however, for smooth insertion, the size of the cross-section of the second coupling projection 403*b* may be a bit smaller than that of the second insertion recess 404*b*.

The second insertion recess 404*b* may include a projection 402*bc* for preventing the second extension part 402*b* from being deviated in the vertical direction while coupled with the second coupling projection 403*b*. The projection 402*bc* may protrude to the inside of the second insertion recess 404*b*. The projection 402*bc* may be inserted to a coupling recess 403*ba* of the second coupling projection 403*b* formed along a perpendicular direction to the direction in which the top door 120 is opened or closed. The coupling recess 403*ba* may be sunken to the inside of the second coupling projection 403*b*. The coupling recess 403*ba* may be provided to have a similar shape to the projection 402*bc*.

Unlike the first extension part 402*a*, the second extension part 402*b* may include a fixing member 409. The fixing member 409 may fix the handle 400 coupled with the coupling projections 403*a* and 403*b*. The fixing member 409 may be coupled with the second extension part 402*b* by passing through a portion where the second insertion recess 404*b* of the second extension part 402*b* is formed. The fixing member 409 coupled with the second extension part 402*b* may have a front end that presses the outer circumferential surface of the second coupling projection 403*b* to prevent the second extension part 402*b* of the handle 400 from being deviated from the second coupling projection 403*b* to the direction in the sliding direction.

While inserted to the first insertion recess 404*a* of the first extension part 402*a*, the first coupling projection 403*a* may define a portion of the right surface of the first extension part 402*a*. With the structure, the coupling portion between the handle 400 and the first coupling projection 403*a* looks neat, which may improve the external appearance.

While inserted to the second insertion recess 404*b* of the second extension part 402*b*, the second coupling projection 403*b* may define a portion of the right surface of the second extension part 402*b*. With the structure, the coupling portion between the handle 400 and the second coupling projection 403*b* looks neat, which may improve the external appearance.

According to the above structure, the handle 400 may be coupled with the top door 120 in a relatively simple mechanism.

Figure 23:
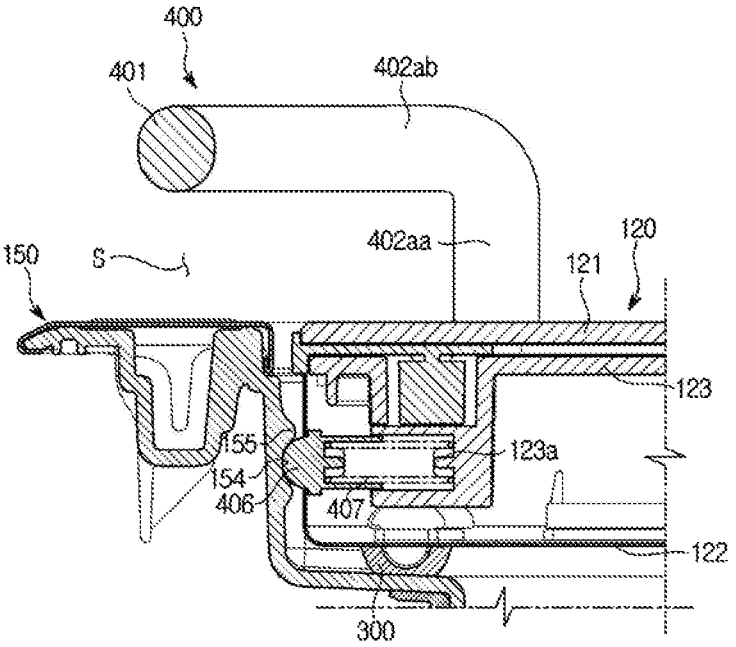
FIG. 23 is a cross-sectional view along line D-D' marked in FIG. 17.

FIG. 23 is a cross-sectional view along line D-D' marked in FIG. 20.

Referring to FIG. 23, the top door 120 may include a locking device 406 and 407 to keep the top door 120 in the closed state. The locking device 406 and 407 may include the lock member 406 and an elastic member 407.

The lock member 406 may be elastically biased by the elastic member 407 in a direction toward the cover frame 150. The lock member 406 may include an inclined surface formed for the top door 120 to be smoothly moved in a direction to contract the elastic member 407 when the top door 120 is closed, i.e., when an end toward the cover frame 150 falls while in contact with the inner surface of the cover frame 150. The lock member 406 may include an inclined surface formed for the top door 120 to be smoothly moved, when the top door 120 is opened, i.e., when the end toward the cover frame 150 rises while in contact with the inner surface of the cover frame 150. The lock member 406 may have the end toward the cover frame 150 shaped like a hemisphere.

The elastic member 407 may have an end fixed to an elastic member fixer 123*a* formed at a middle frame 123 and the other end fixed to the lock member 406. The elastic member 407 may press the lock member 406 to a direction in which the lock member 406 protrudes from the top door 120. The elastic member 407 may press the lock member 406 in a direction toward the cover frame 150.

The cover frame 150 may include a lock member insertion part 154 to which the one end of the lock member 406 is inserted. The lock member insertion part 154 may be provided on the inner surface of the cover frame 150 to correspond to a position in which the lock member 406 protrudes when the top door 120 is closed.

The cover frame 150 may include a movement restriction part 155 to restrict upward movement of the lock member 406 so that the top door 120 is opened when the force with more than a certain strength is applied while the door 120 is closed, i.e., while the lock member 406 is inserted to the lock member insertion part 154. The movement restriction part 155 may protrude toward the top door 120 from the inner surface of the cover frame 150. The movement restriction part 155 may be formed above the lock member insertion part 154.

With this structure, the top door 120 in the embodiment of the disclosure may remain closed in a relatively simple mechanism.

Figure 24:
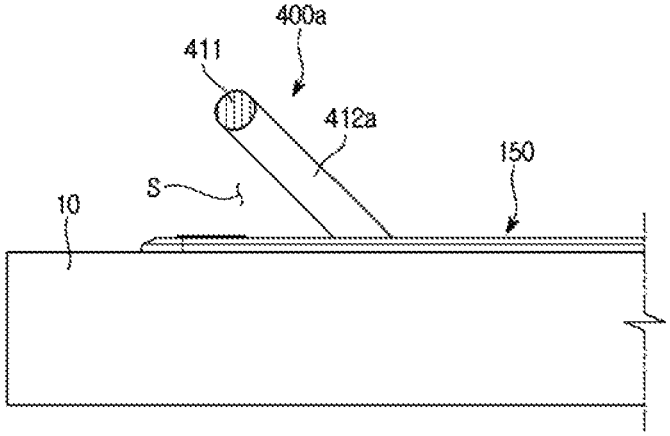
FIG. 24 shows a handle, according to another embodiment of the disclosure.

FIG. 24 shows a handle, according to another embodiment of the disclosure. What are overlapped with FIGS. 17 and 23 will be omitted in the following description.

Referring to FIG. 24, a handle 400*a* may extend from the top surface of the top door 120 to a grip part 411 at an angle with the top surface of the top door 120. The handle 400*a* may include an extension part 412*a* that extends from the top surface of the top door 120 to a grip part 411 at an angle with the top surface of the top door 120. The grip part 411 may be arranged forward further than the front end of the top door 120. The grip part 411 may be arranged above the cover frame 150. Accordingly, the handle 400*a* may form the grip space S between the top door 120 and the cover frame 150.

Figure 25:
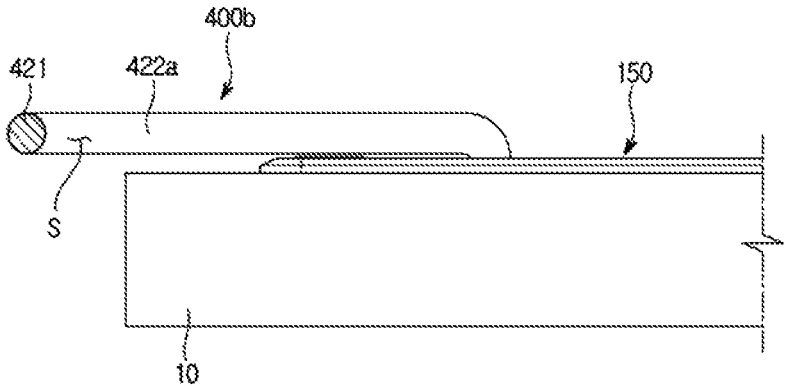
FIG. 25 shows a handle, according to another embodiment of the disclosure.

FIG. 25 shows a handle according to another embodiment of the disclosure. What are overlapped with FIGS. 17 and 23 will be omitted in the following description.

Referring to FIG. 25, a grip part 421 of a handle 400*b* may be located forward further than the front end of the counter 10. An extension part 422*a* of the handle 400*b* may extend forward from the top surface of the top door 120 to the grip part 421. Specifically, unlike the handle 400 as shown in FIGS. 17 to 23, the handle 400*b* of FIG. 25 may extend forward along the top surface of the top door 120 without being barely separated from the top surface of the top door 20.

With this structure, the handle 400*b* as shown in FIG. 25 may define the grip space S between the grip part 421 and the front end of the counter 10. Furthermore, as the extension part 422*a* of the handle 400*b* extends forward without being barely separated from the top surface of the top door 120, inconvenience that might felt by the user due to protrusion of the handle 400*b* when the user is doing something or cooking on the counter 10 may be reduced.

Figure 26:
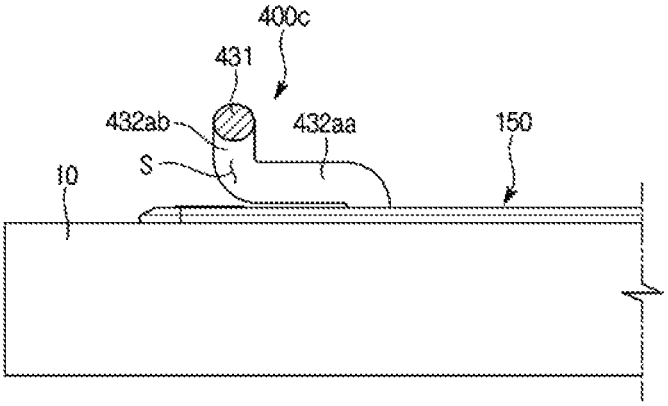
FIG. 26 shows a handle, according to another embodiment of the disclosure.

FIG. 26 shows a handle, according to another embodiment of the disclosure. What are overlapped with FIGS. 17 and 23 will be omitted in the following description.

Referring to FIG. 26, a handle 400*c* may include a grip part 431 located above the cover frame 150, and an extension part 432*aa* and 432*ab* connecting the grip part 431 to the top surface of the top door 120. The extension part 432*aa* and 432*ab* may include a first extension 402*aa* extending forward from the top surface of the top door 120 like the extension part 422*a* as shown in FIG. 25, and a second extension 432*ab* extending upward from the first extension part 432*aa* to the grip part 431. Accordingly, the grip part 431 may define the grip space S between the top door 150 and the cover frame 120.

Figure 27:
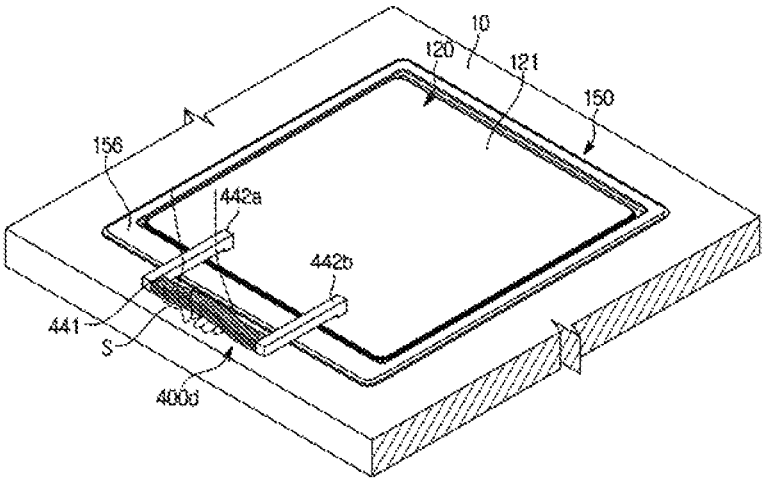
FIG. 27 shows a handle gripped by the user, according to another embodiment of the disclosure.

FIG. 27 shows a handle gripped by the user, according to another embodiment of the disclosure. What are overlapped with FIGS. 17 and 23 will be omitted in the following description.

Referring to FIG. 27, a handle 400*d* may include a grip part 441 gripped by the user, and extension parts 442*a* and 442*b* connecting the grip part 441 to the top door 120. The extension parts 442*a* and 442*b* may include first and second extension parts 442*a* and 442*b*. The grip part 441 may lie above the counter 10. Alternatively, the grip part 441 may lie above the cover frame 150. The grip part 441 may be arranged forward further than the front end of the top door 120.

The grip part 441 may be formed with a more flexible material than for the extension parts 442*a* and 442*b*. The grip part 441 may include a material that is deformable when more than certain strength of force is applied to the material. The grip part 441 may be deformed to define the grip space S with the counter 10 when the user pulls up the grip part 441 to open the top door 120. When the user releases the grip part 441 later, the grip part 441 may return to its original form.

With this structure, the handle 400*d* as shown in FIG. 27 may reduce inconvenience that might felt by the user due to the protrusion when the user is doing something or cooking on the counter 10, and may define the grip space S when required, allowing the top door 120 to be easily opened or closed.

The dish washer may be installed in a standalone type rather than in the built-in type. This standalone dish washer is defined as a free standing type dish washer. In the following description, the free standing type dish washer will be focused.

Figure 28:
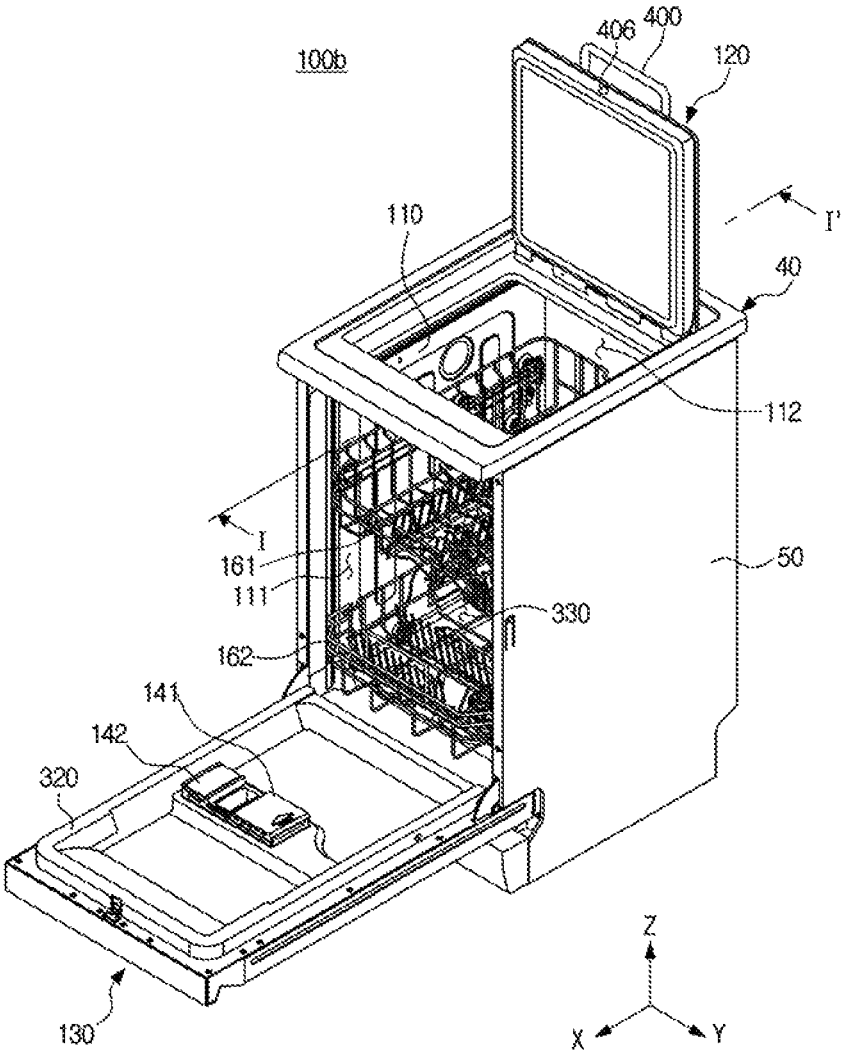
FIG. 28 shows a dish washer, according to another embodiment of the disclosure.
Figure 29:
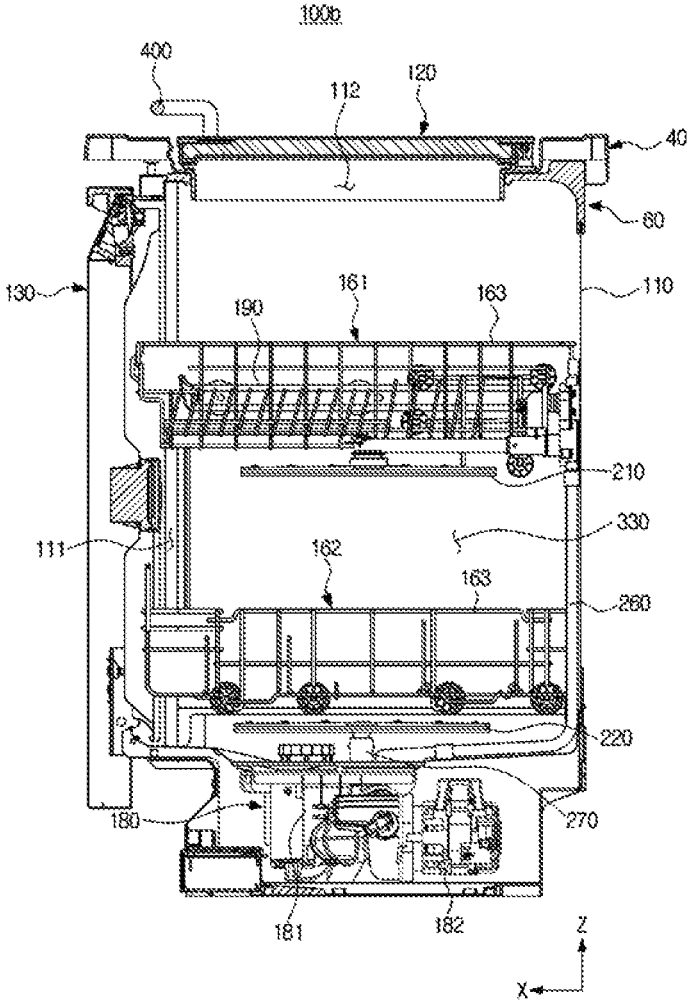
FIG. 29 is a cross-sectional view along line I-I' marked in FIG. 28.
Figure 30:
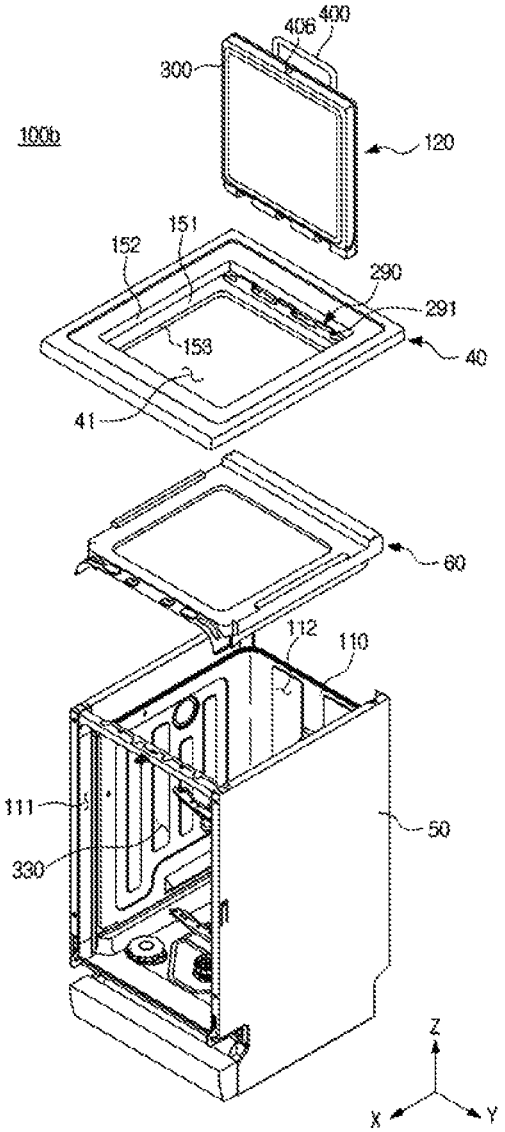
FIG. 30 is an exploded view of the dish washer of FIG. 28.

FIG. 28 shows a dish washer, according to another embodiment of the disclosure, and FIG. 29 is a cross-sectional view along line I-I' marked in FIG. 28. FIG. 30 is an exploded view of the dish washer shown in FIG. 28. Description overlapping with that of the built-in type dish washer will not be repeated in the following description. In FIG. 30, the front door 130 is not shown.

Referring to FIG. 28 to 30, a dish washer 100*b* may include a housing 50 that defines the exterior.

The dish washer 100*b* may further include the tub 110 defining the cleaning space 330 therein. The tub 110 may be arranged in the housing 50. The tub 110 may include the front opening 111 that may be opened or closed by the front door 130. The front opening 111 may be larger than an opening 41 formed at a cover frame 40 The tub 110 may further include the top opening 112 that corresponds to the opening 41 formed at the cover frame 40.

The dish washer 100 may further include a plurality of doors 120 and 130 for user convenience. Specifically, the dish washer 100*b* may include the top door 120 provided for top loading of dishes, and the front door 130 provided for front loading of dishes. The top door 120 and the front door 130 may each be pivotally installed. The forms of installation of the top door 120 and front door 130 are not, however, limited thereto, but may be variously changed. Hereinafter, it is assumed that the top door 120 and the front door 130 are pivotally installed. The top door 120 may be pivotally mounted at a cover frame 40. The front door 120 may be pivotally mounted at a tub 110.

The front door 130 may be provided with at least one of the detergent container 141 for supplying a detergent into the tub 110 and the rinse container 142 for supplying a rinse into the tub 110.

The dish washer 100 may further include the cover frame 40. The cover frame 40 may be arranged above the tub 110. The top door 120 may be installed on the cover frame 40.

The cover frame 40 may include the rest 151 on which the top door 120 is rested. Specifically, on the rest 151 of the cover frame body 40, the top door hinge 290 including the hinge shaft 291 may be mounted. The top door 120 may be coupled with the top door hinge 290 to pivot on the hinge shaft 291. The hinge shaft 291 of the top door hinge 290 may extend in the left-right direction Y of the dish washer 100*b*.

The cover frame 40 may further include the first wall 152 extending from the rest 151 in the vertical direction Z of the dish washer 100*b*. Specifically, the first wall 152 may vertically extend from the outer end of the rest 151 to the upward direction of the dish washer 100*b*. The rest 151 may face the bottom surface of the top door 120, and the first wall 152 may face the sides of the top door 120. In other words, the rest 151 and the first wall 152 may define a top door receiving space to accommodate the top door 120.

The cover frame 40 may further include the second wall 153 extending from the rest 151 in the vertical direction Z of the dish washer 100*b*. Specifically, the second wall 153 may vertically extend from the inner end of the rest 151 to the downward direction of the dish washer 100*b*.

The first wall 152 may extend to be longer than the second wall 153 in the vertical direction Z of the dish washer 100*b*. That is, the first wall 152 may be longer than the second wall 153 in the vertical direction Z of the dish washer 100*b*.

The space defined by the first wall 152 may be wider in the left-right direction Y of the dish washer 100*b* than the space defined by the second wall 153.

The dish washer 100*b* may further include the top door sealing member 300. The top door sealing member 300 may be coupled with the top door 120. The top door sealing member 300 may supplement a seal between the cover frame 120 and the top door 120 to prevent the water inside the tub 10 from leaking out of the top door 40. The top door sealing member 300 may be formed of an elastic material. For example, the top door sealing member 300 may be made of e.g., rubber.

The dish washer 100*b* may further include a coupling frame 60 arranged between the tub 110 and the cover frame 40. The coupling frame 60 may be arranged between the cover frame 40 and the tub 110 in the vertical direction Z of the dish washer 100*b* to couple the cover frame 40 to the tub 110.

The dish washer 100*b* may further include at least one basket 161 and 162 arranged in the tub 110 to be put in or pulled out through the front opening 111. The at least one basket 161 and 162 may also be termed a 'front loading basket'. For example, the dish washer 100*b* may include the upper basket 161 arranged in an upper portion of the tub 110 and the lower basket 162 arranged under the upper basket 161 in the vertical direction of the dish washer 100*b*. The at least one basket 161 and 162 is described above in connection with FIGS. 3 and 4, so the description thereof will not be repeated.

The dish washer 100*b* may further include the front door sealing member 320. The front door sealing member 320 may be coupled with the front door 130. The front door sealing member 320 may supplement a seal between the tub 110 and the front door 130 to prevent the water inside the tub 10 from leaking out of the front door 130. The front door sealing member 320 may be formed of an elastic material. For example, the front door sealing member 320 may be made of e.g., rubber.

The front door 130 of the dish washer 100*b* may define the front exterior of the dish washer 100*b*.

The top door 120 of the dish washer 100*b* may define the top exterior of the dish washer 100*b*. Specifically, the top door 120 of the dish washer 100*b* may define the top exterior of the dish washer 100*b* together with the cover frame 40.

The dish washer 100*b* may include the handle 400 provided for the user to grip to open or close the top door 120. The dish washer 100*b* as shown in FIGS. 28 to 30 may include the same handle 400 as shown in FIGS. 17 to 23. It is not, however, limited thereto, and the dish washer 100*b* may include one of the handles 400*a*, 400*c*, and 400*d* as shown in FIGS. 24, 26, and 27, respectively.

According to embodiments of the disclosure, a dish washer having both front and top doors may be provided to allow dishes to be both front loaded and top loaded.

A cover frame and a tub of the dish washer may be coupled by a coupling member that may be expanded or contracted in the vertical direction of the dish washer, easily adjusting the gap between the cover frame and the tub, which may vary by thickness of a counter.

As the dish washer enables to clean dishes not only in a washing space formed in the tub but also in a washing space defined by the cover frame and the coupling member, it may secure a wider washing space than in the conventional dish washer that has just a washing space formed in the tub.

The dish washer has a handle to open the top door located further forward than the front end of the top door, thereby allowing the user to easily grip the handle while the top door is opened.

Several embodiments have been described above, but a person of ordinary skill in the art will understand and appreciate that various modifications can be made without departing the scope of the disclosure. Thus, it will be apparent to those ordinary skilled in the art that the true scope of technical protection is only defined by the following claims.

What is claimed is:

1. A dish washer installed in a built-in type in a system kitchen comprising a cabinet having a storage room and a counter arranged on the cabinet to have an opening, the dish washer comprising:

a tub having a front opening;

a front door provided to open or close the front opening;

a cover frame mounted on the opening of the counter to be separated from the tub in a vertical direction of the dish washer;

a top door installed on the cover frame to open or close the opening of the counter; and a coupling member coupling the cover frame to the tub to be expanded or contracted in the vertical direction of the dish washer and comprising an elastic material.

2. The dish washer of claim 1, wherein the coupling member has the form of a closed loop.

3. The dish washer of claim 1, wherein the coupling member comprises at least one bent portion.

4. The dish washer of claim 1, wherein the coupling member comprises:

a first end coupled to the cover frame; and a second end coupled to the tub and located outside the first end.

5. The dish washer of claim 4, wherein the first end of the coupling member is located outside the cover frame to cover an outer surface of the cover frame, and the dish washer further comprises a wire arranged along edges of the coupling member to fix the first end of the coupling member to the cover frame.

6. The dish washer of claim 4, wherein the tub comprises a top opening corresponding to the opening of the counter, and wherein the second end of the coupling member is coupled to an inner surface of the tub after passing through the top opening of the tub.

7. The dish washer of claim 6, further comprising: a fastening member fixing the second end of the coupling member to the inner surface of the tub from inside of the tub to an upward direction of the dish washer.

8. The dish washer of claim 6, further comprising: a fastening member fixing the second end of the coupling member to the inner surface of the tub in a left-right direction or front-back direction of the dish washer.

9. The dish washer of claim 4, wherein the cover frame has an outer surface with a plurality of projections arranged to be separated from each other in the vertical direction of the dish washer, and wherein the first end of the coupling member comprises a latch caught in between the plurality of projections.

10. The dish washer of claim 4, wherein the cover frame has one end toward the tub with a coupling groove formed along edges of the cover frame, and wherein the first end of the coupling member has a coupler to be coupled into the coupling groove.

11. The dish washer of claim 1, wherein the tub comprises a tub body; and a tub top coupled into an upper portion of the tub body and having a water collector, wherein the coupling member couples the cover frame to the tub top.

12. A dish washer installed in a built-in type in a system kitchen comprising a cabinet having a storage room and a counter arranged on the cabinet to have an opening, the dish washer comprising:

a tub having a front opening;

a front door provided to open or close the front opening;

a cover frame mounted on the opening of the counter;

a top door installed on the cover frame to open or close the opening of the counter; and a coupling member provided to define a space located between the cover frame and the tub in a vertical direction of the dish washer and comprising an elastic material, wherein the space defined by the coupling member varies by thickness of the counter.

13. The dish washer of claim 12, wherein the space defined by the coupling member increases when the counter is thick and decreases when the counter is thin.

14. The dish washer of claim 12, wherein the coupling member is able to expand or contract in the vertical direction of the dish washer.

15. The dish washer of claim 12, wherein the cover frame is mounted on the opening of the counter to be separated from the tub in the vertical direction of the dish washer.

16. The dish washer of claim 12, wherein the cover frame comprises a first space in which the top door is rested; and a second space located under the first space in the vertical direction of the dish washer, wherein the space defined by the coupling member is located between the second space and the tub in the vertical direction of the dish washer.

17. The dish washer of claim 16, wherein the first space is larger in width than the second space.

* * * * *